US006493996B1

(12) United States Patent
Alexander et al.

(10) Patent No.: US 6,493,996 B1
(45) Date of Patent: Dec. 17, 2002

(54) MODULAR BUILDING CONSTRUCTION SYSTEM

(76) Inventors: Simon Alexander, 48 Barn Hill, Wembley Park, Middlesex HA9 9LQ (GB); James Sanderson Tasker, 21 Dartmouth Street, St. James Park, London SW1H 9BP (GB)

( * ) Notice: Subject to any disclaimer, the term of this patent is extended or adjusted under 35 U.S.C. 154(b) by 0 days.

(21) Appl. No.: 09/546,478

(22) Filed: Apr. 10, 2000

(30) Foreign Application Priority Data

Apr. 14, 1999 (GB) ..... 9908548
Dec. 9, 1999 (GB) ..... 9929183

(51) Int. Cl.[7] ..... E04H 1/00; E04H 14/00; E04H 3/00; E04H 5/00; E04H 6/00; E04H 9/00

(52) U.S. Cl. ..... 52/79.9; 52/79.3; 52/591.1; 52/591.2; 52/592.1; 52/234; 52/236.3; 52/79.1; 52/250; 52/251; 52/79.4; 52/608; 52/583.1; 52/587.1

(58) Field of Search ..... 52/79.3, 79.9, 52/591.1, 591.2, 592.1, 234, 236.3, 79.1, 250, 251, 79.4, 608, 583.1, 587.1

(56) References Cited

U.S. PATENT DOCUMENTS 4,050,215 A * 9/1977 Fisher ..... 52/79.3
4,073,102 A 2/1978 Fisher
4,194,339 A 3/1980 Fisher
4,671,039 A * 6/1987 Hunt ..... 52/593

FOREIGN PATENT DOCUMENTS

FR 91-059897/09 * 1/1991
FR 91-059897/09 2649-14 * 1/1991
SU B2461A/06 * 6/1977
SU B2461A/06 554-158 * 6/1977
SU G2667B/29 * 9/1978
SU G2667B/29 626-189 * 9/1978

* cited by examiner

*Primary Examiner*—Lanna Mai
*Assistant Examiner*—Chi Q Nguyen
(74) *Attorney, Agent, or Firm*—Biebel & French, LPA

(57) ABSTRACT

A prefabricated room module (1) is provided for use in the construction of a modular building. The room module comprises a floor slab (2) of generally rectangular shape in plan, and load bearing walls (3,4) formed at adjacent sides of the slab and mutually adjoining at a common corner (5). The module has no ceiling slab opposite the floor slab (2) and an open face opposite one of the load bearing walls (4) which constitutes a party wall. Opposite another of the load bearing walls (3) the module may be open or include a further wall (7) which can have an access opening (10) therein for providing service access to a kitchen or bathroom pod (9) installed in a corner of the module. Edges of the floor slab (2) have projecting tongues (11) and fastening means for engaging complementary recesses and fastening means respectively of an adjacent module. The module may have a ceiling slab instead of a floor slab (2).

55 Claims, 19 Drawing Sheets

MODULAR BUILDING CONSTRUCTION SYSTEM

BACKGROUND OF THE INVENTION

The present invention relates to modular building construction systems and, more particularly, to prefabricated room modules which may be used to construct room units, optionally including bathrooms or kitchens, for such construction systems, and which may be used, for example, in the construction of dormitory and hotel type accommodation, apartments, social housing and educational buildings.

Room modules for modular building construction systems are conventionally manufactured and prefinished in a factory before being transported to and assembled on site. An advantage of using room modules instead of other traditional building methods is that much of the work is carried out in a factory where labour costs are cheaper. Also, work carried out in a factory is unaffected by adverse weather conditions, unlike work carried out on site.

Bath and shower rooms including toilet facilities, as well as kitchens, may either be installed in the room modules at the construction site in the traditional manner or in a factory, off site. They may be prefabricated in the form of three dimensional components commonly known as "pods". Hitherto, pods have been transported to the construction site and hoisted into position in the modules in which they are to be installed.

In order for a modular building construction system to be economically viable, it is important to maintain transportation and cranage costs for the room modules, as well as the fabrication costs, at a minimum. In order to maintain such costs at a minimum, the room modules are subject to certain constraints with regard to dimensions and weights. Hence, the maximum width which can presently be transported economically is 3.5 m in certain countries. The maximum load permitted per vehicle is presently 26 tonnes. Consequently, if a room module including a fitted bathroom or kitchen exceeds about 13 tonnes in weight, only one module can be transported at a time, thereby virtually doubling transportation costs. Moreover, the weights of room modules have a direct bearing on cranage costs at a construction site. Modules weighing less than 8 tonnes can be hoisted by a variety of cranes which are relatively cheap to hire, whereas modules weighing 13 tonnes or more need to be hoisted on rather more expensive, specialised cranes. As to fabrication costs, whilst precast concrete of thinner cross section uses less concrete and also weighs less, the cost of such concrete tends to be more per cubic meter because of the increased labour costs involved. Much greater care requires to be taken in making and handling thin concrete components.

Multi-storey buildings erected using a modular construction system typically comprise a plurality of room units assembled from precast concrete modules positioned side-by-side and stacked one on top of another. Such systems are described in U.S. Pat. Nos. 4,050,215 and 4,194,339. Both these systems utilize (a) a series of rectangular room modules, each of which has only two load bearing walls joined by a floor panel and are open at ceiling level, and (b) a series of rectangular tubular room modules, each of which has two opposite load bearing walls for transmitting vertical loads joined via floor and ceiling panels. The (b) modules are used only on the top storey of a building construction, and the (a) modules are used for all the lower storeys. The modules in successive storeys are arranged so that the walls for transmitting vertical loads above are aligned with those below. In the system of U.S. Pat. No. 4,050,215, the room modules on each level are installed with conjugation of the location of the load bearing walls i.e. so that the load bearing walls of any one module in one storey lie perpendicular to the load bearing walls of all immediately adjacent modules in the same storey. In the system of U.S. Pat. No. 4,194,339, the modules in each storey are installed end-to-end so as to form a continuous living space in a longitudinal direction and side-by-side so as to form a separate series of living spaces with double party walls separating the living spaces in the transverse direction.

A problem with precast concrete frame and/or panel construction systems is that if a load bearing wall or column fails, it can cause the progressive collapse of the entire structure above it. Another problem is that these room modules are formed in expensive moulds which are required for casting the opposed walls so as to be mutually parallel. Additionally, the moulds may also be required to form mutually parallel floor and ceiling panels.

SUMMARY OF THE INVENTION

It is an objecT of the present invention to alleviate the above problems and provide a room module having a more stable modular construction.

According to one aspect of the present invention there is provided a prefabricated room module for use in the construction of a modular building, comprising a slab of generally rectangular shape in plan, and load bearing walls, characterized in that the slab is a floor or ceiling slab and that said load bearing walls are formed at adjacent sides of the slab and mutually adjoin at a common corner.

The room module of the invention may be of monolithic precast and reinforced concrete construction. Such a module integrally formed from precast concrete is inherently much stronger than other known room modules and enables a reduction in the use of materials and waste.

It may be desirable for one of the walls of the room module to be prefabricated with at least one door or window opening and this wall, in the modular building, may form an outside wall or corridor wall section, depending on the type of opening, with the other load bearing wall forming a party wall.

Conveniently, the room module can include a prefabricated bathroom or kitchen pod.

A module according to the invention and, preferably, cast with a floor slab, is suitable for use in erecting low cost accommodation, such as, dormitories and two star hotels. A suitable room unit for such accommodation may be provided by a room module which is approximately 6 m×3 m. The load bearing wall along the shorter side of the floor slab is cast with a window opening and forms the inner skin of an outer cladding system of the building. The other load bearing wall is a party wall. Such modules may be stacked one on top of the other up to a height of 10 storeys with the same load bearing wall thickness for all storeys. For example, up to 10 storeys the load bearing walls will generally be of the order of 100 mm thick unless for acoustic purposes they need to be made up to 150 mm thickness. Floors up to 3.2 m spans may be of the order of 100 mm thick and longer spans, up to ±4 m, will be 120 mm thick. If greater acoustic properties are required for floors, a floating floor may be provided on top of the floor slab. The modules are stacked with the load bearing walls of the modules aligned in vertical planes.

Conveniently, a third wall of less width than the module is cast along the corridor side of the floor slab, opposite the wall having the window opening, and in adjoining relation with the adjacent party wall, whereby a bathroom pod may be accommodated between this third wall, which forms a corridor wall, and the party wall. Such a module affords constructors an added advantage in that the bathroom pods can be delivered to the factory in which the modules are precast and where they can be installed in the module prior to delivery to the construction site. This has a number of advantages, the main one being the saving of time at the site as the pod is hoisted into position as part of the module and not as a separate element. The maximum weight of this module, including the bathroom pod, is advantageously less than 13 tonnes.

Fixing points for mechanical fastening devices may be cast into the floor or ceiling slab and load bearing walls at or adjacent their free edges so as to enable the module to be tied to adjacent modules both horizontally and vertically. At least the free edge of the floor or ceiling slab opposite the load bearing wall serving as a party wall may be cast with projecting tongues and the opposite edge of the slab, below the party wall, may be cast with complementary rebates, whereby the projecting tongues can rest in the rebates of an adjacent similar module in the same storey and be supported by the load bearing wall of another similar module in the storey below.

Where a building construction requires longer or larger room units which cannot be constructed from a single room module according to the invention without breaching the above mentioned constraints, the room unit may be assembled from a main room module constructed according to the invention and one or more prefabricated supplementary modules, each of which comprises a rectangular floor or ceiling slab and a load bearing wall along one side of the slab so as to coincide with the party wall of the main module. The supplementary module is adapted to be fixed to the main module with the free sides of its slab and load bearing wall contiguous with the free sides of the slab and party wall of the main module.

In one embodiment suitable, for example, for constructing three star hotels, the room unit may be assembled from one main module comprising two adjacent load bearing walls and a floor slab, and one supplementary module. The supplementary module may be fitted with a bathroom or kitchen pod. In those cases where the constructor requires the floor level of a bathroom to be the same as the bedroom lobby, the supplementary module may be set down slightly to permit this to be achieved. The resulting recess may then be filled with lightweight screed. Alternatively, the whole floor of the room unit may be raised with a floating floor or screed to match the floor level of the bathroom or kitchen pod.

In another embodiment having larger room units, such as may be required, for example, for four star hotels, the room unit may be formed from a main room module and two supplementary modules to permit economic transportation. Such room units may have a clear internal width exceeding 3.2 m. For four star hotels, the overall dimensions of a room unit comprising the three modules may be about 3.7 m×6.5 m and for five star hotels 4 m×8 m. A prefabricated bathroom pod may be installed in the outer one of the supplementary modules which will be adjacent the corridor of a hotel.

In embodiments utilising supplementary modules, the room units can also be stacked up to a height of ten storeys utilising the same wall thickness for all storeys. The maximum weight of the heaviest of the modules should be less than 8 tonnes, thus reducing the cost of cranes needed for hoisting purposes. In these embodiments, the floor slab of the or each supplementary module will span across the width of the room unit and, similarly to a main room module constructed according to the invention, each supplementary module may be cast with tongues projecting from the edge of the slab opposite the load bearing wall and with complementary rebates in the corner edge between the slab and the wall so that the tongues of the floor slab can bear on the party wall of a like supplementary module in the storey below.

According to another aspect of the present invention there is provided a prefabricated room module for use in the construction of a multi-storey modular building, comprising a floor or ceiling slab, a wall formed along one side of the slab, at least one upright projection from a top or bottom edge of the wall, at least one first anchor member at the opposite edge of the wall having a first coupling hole for engaging a cooperating projection of an adjoining like module in the next storey above or below, at least one second anchor member projecting from the edge of the slab opposite the wall and having a second coupling hole also for engaging a cooperating projection of an adjoining like module in the next storey above or below, and means for securing the projection through cooperating first and second holes of adjoining like modules.

When the room module has a floor slab, the projection(s) are conveniently on the top edge of the wall and, when the room module has a ceiling slab, the projection(s) are conveniently at the bottom edge of the wall.

When erecting a building using, for example, room modules embodying the invention and comprising floor slabs, the room modules in an upper storey are lowered onto the modules of the storey immediately below and are assembled so that the projection(s) from the wall of a room module in the storey below engage the coupling holes in the anchor members of the two room modules in the upper storey having, respectively, the free edge of its floor slab and the bottom edge of its wall supported on the upper edge of the wall of the lower module wall. The projection(s) are then secured to the anchor members so as to tie the three adjoining modules together in both the horizontal and vertical directions. Preferably, the projection(s) are bolts or other screw threaded rods which are secured to the anchor members by nuts.

The invention also consists in a modular building construction system erected using prefabricated room modules according to the invention.

Embodiments of the present invention will now be described by way of example with reference to the accompanying drawings.

DETAILED DESCRIPTION OF THE PREFERRED EMBODIMENT

Figure 1:
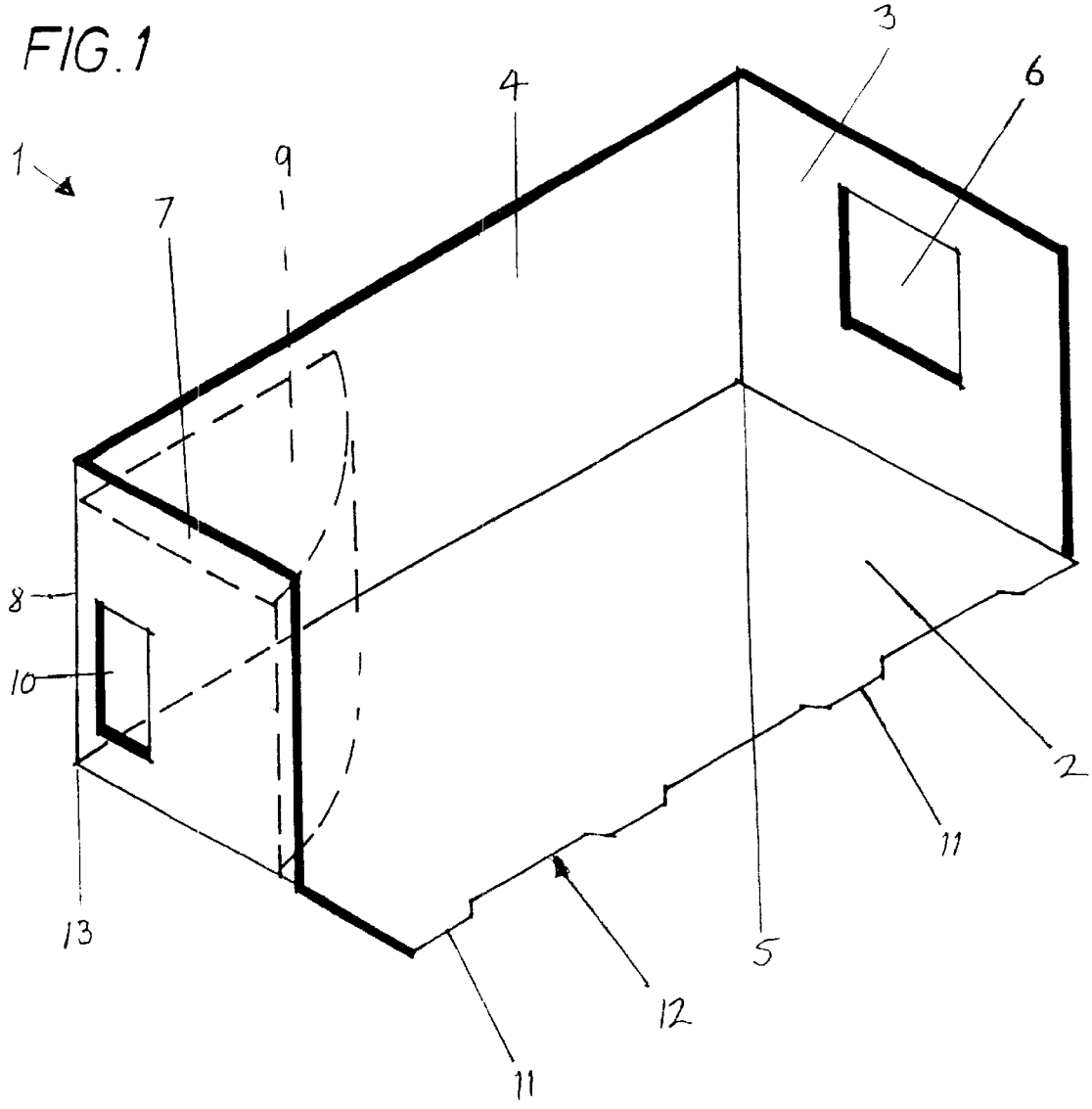
FIG. 1 is an isometric view of a precast room module constructed in accordance with the invention.

Referring to FIG. 1 of the accompanying drawings, a prefabricated room module 1 for use as a room unit in the construction of a modular building comprises a floor slab 2 of generally rectangular shape in plan, and first and second load bearing walls 3,4 formed at adjacent sides of the slab and mutually adjoining at a common corner 5. The room module is of monolithic precast and reinforced concrete construction. The first load bearing wall 3, which is intended to form part of the inner skin of an outer cladding system of the building, is cast with a window opening 6 and the second load bearing wall 4 forms the party wall between adjacent room units. A third wall 7 is cast along the side of the floor slab opposite the wall 3. It adjoins the load bearing wall 4 at a common corner 8 and extends only part way along the side of the floor slab. This third wall is intended to form part of the corridor wall of a building and a prefabricated bathroom pod 9 is installed in the module between the party and corridor walls 4,7. The third or corridor wall is cast with an access opening 10 for the supply of bathroom services to the bathroom pod.

Projecting tongues 11 are cast along the free edge 12 of the floor slab opposite the party wall 4, and the corner edge 13 of the slab below the party wall is cast with complementary rebates 14 (see FIG. 3) for receiving the projecting tongues 11 of an adjacent, like module 1.

Figure 2:
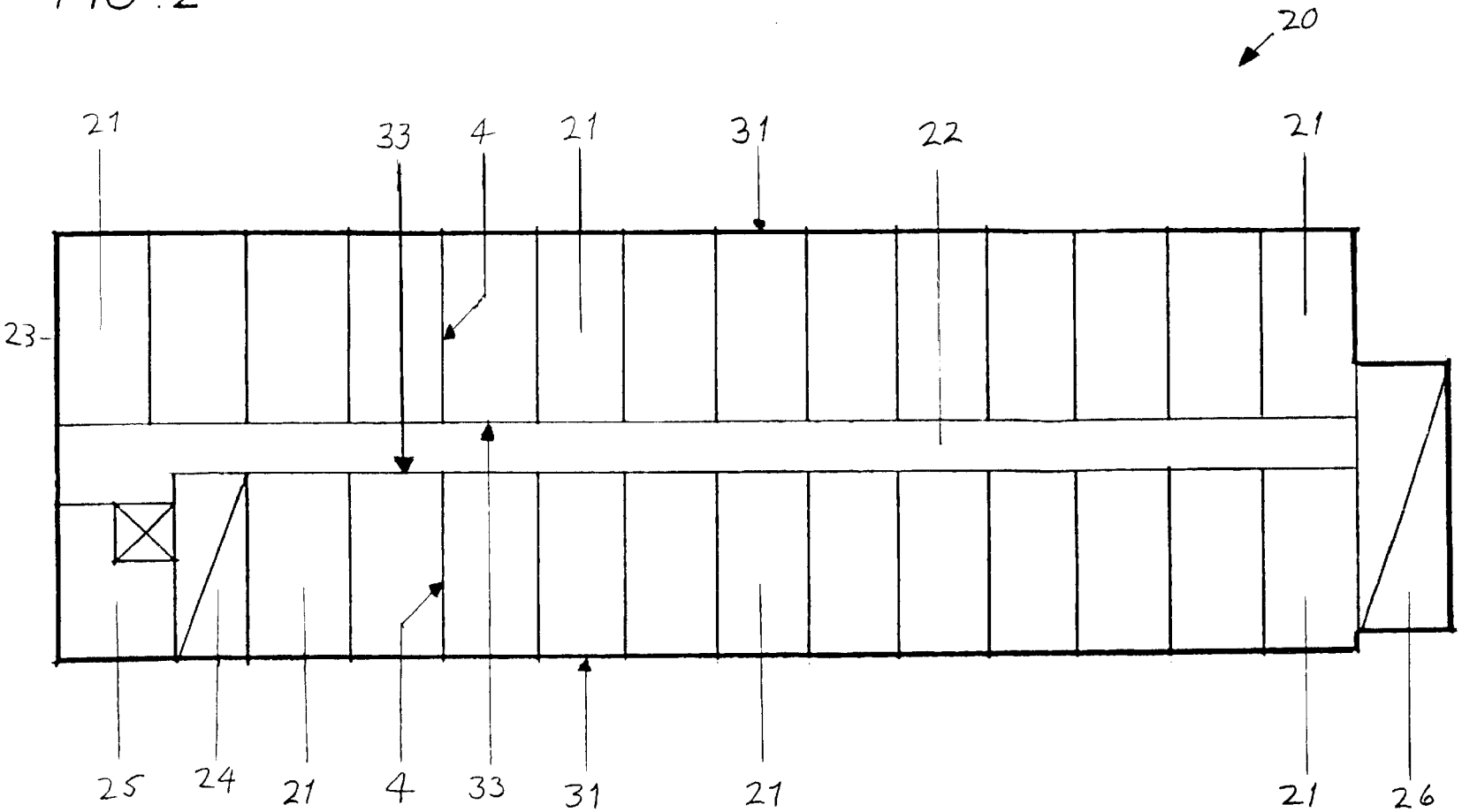
FIG. 2 is floor plan of a modular building constructed with the room modules of FIG. 1.

In one example, the floor slab 2 of the room module illustrated in FIG. 1 is approximately 6 m long and 3 m wide. The first or outside load bearing wall 3 may, for example, be 90 mm thick, the second or party load bearing wall 4 may be 100 mm thick (unless required to meet a stringent acoustic specification, whereupon it may be up to 160 mm thick), the corridor wall 7 may be 90 mm thick and the floor slab may be 100 mm thick. The design of the room module is such that its maximum weight, including the prefabricated bathroom pod, is less than 13 tonnes. It is designed to be used for assembling a single room unit of a hotel or dormitory and FIG. 2 illustrates a sample floor plan of a multi-storey building 20 erected using a multiplicity of the prefabricated room modules 1 shown in FIG. 1. The floor plan of the building is of generally rectangular shape and, on each floor it has two rows of room units 21 on opposite sides of a central corridor 22. When assembled in the building, the open side of each module 1, with the exception of the room modules at one end of the building, is closed by the first or party load bearing wall 4 of the adjoining room module. The open sides of the last modules at one end of each storey are closed by a special end wall 23 for the building or by special structures, such as, a stairwell and/or lift shaft 24,25. The floor plan also includes a second stairwell 26 at the opposite end of the building.

Figure 3:
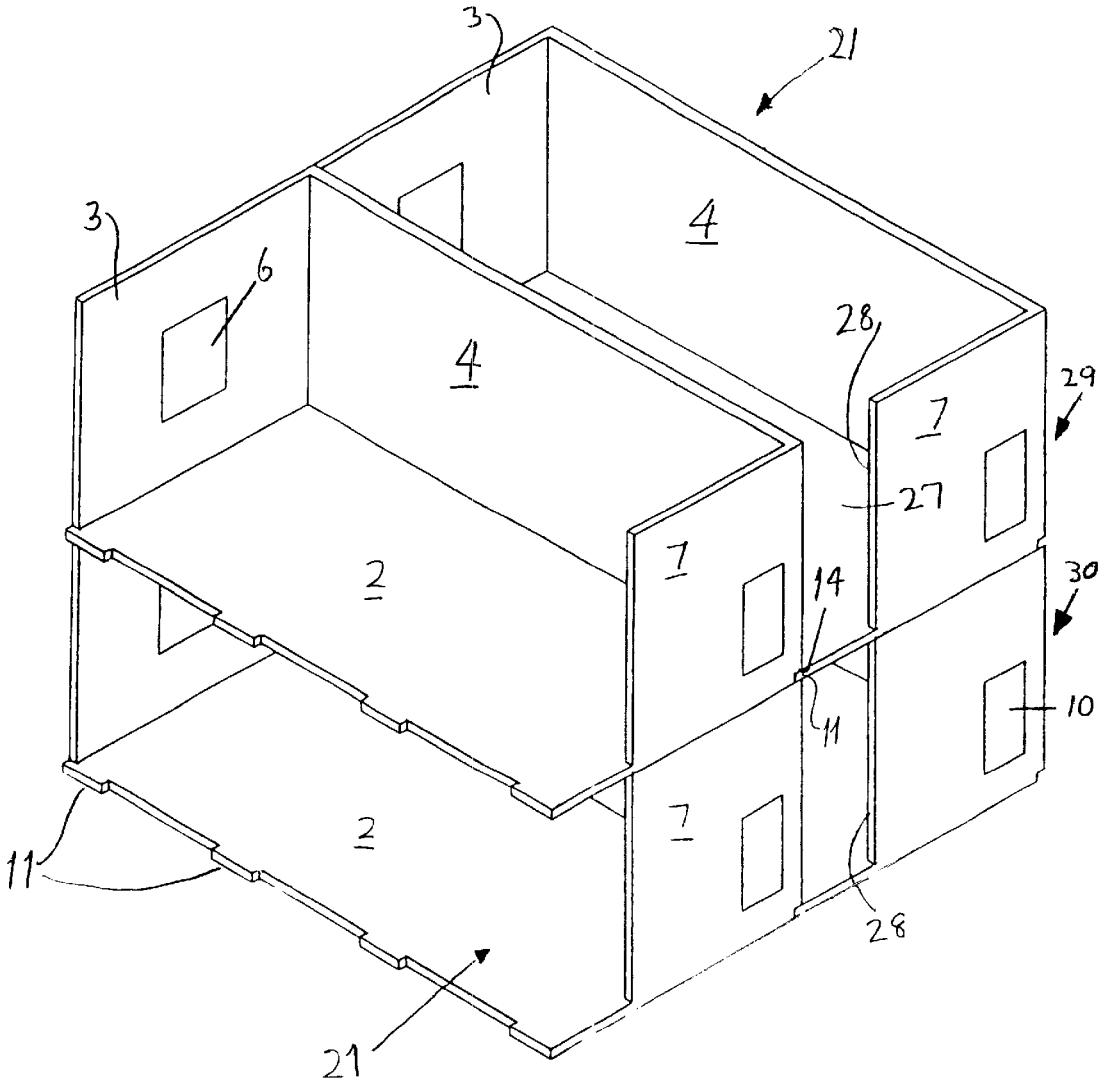
FIG. 3 is an isometric view of part of the building having the floor plan of FIG. 2 and constructed with room modules as shown in FIG. 1.

FIG. 3 illustrates four room units 21 in two storeys 29,30 of the building 20 of FIG. 2, each room unit being identical and comprising a room module 1 as shown in FIG. 1. The room units illustrated are adjoining room units in two storeys 29,30 on the same sides of the building corridors 22. Room units on the opposite sides of the corridors are omitted for clarity. The outer load bearing walls 3 of the room modules form the inner skin of the outer cladding system 31 (FIGS. 4 and 5) of the building and are part of a substantially vertical load plane. The load bearing walls 4 form the party walls between adjoining room units with the party wall of one room unit closing the adjacent open side of the adjoining unit. The walls 33 of the corridors are formed by the corridor wall sections 7 of the modules. As each wall section 7 is less than the full width of its associated slab, in the assembled condition of the room modules, an opening 27 is left between the free edge 28 of the wall section 7 and the adjoining module 1 for mounting a door structure.

The units are stacked with the load bearing walls 3,4 of the upper storey 29 directly above the load bearing walls 3,4 of the next storey 30 below and are part of substantially vertical load planes. The projecting tongues 11 of the floor slab 2 of each unit of one storey 29 bear on the load bearing party wall 4 of the diagonally adjacent unit on the next storey 30 below, via the rebates 14 in the adjacent corner edge of the adjoining unit in the same storey.

Figure 4:
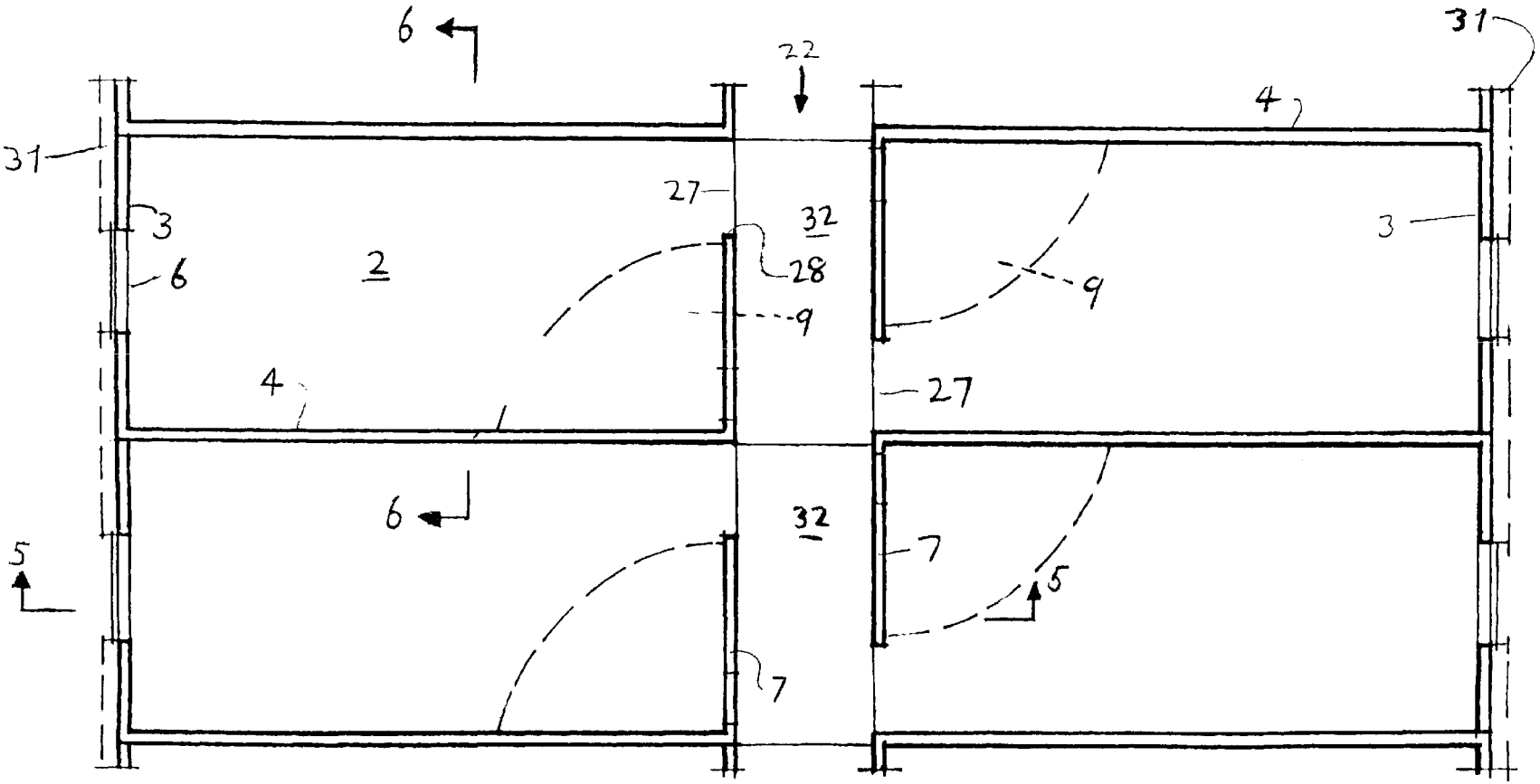
FIG. 4 is a fragmentary view of the floor plan of FIG. 2 on an enlarged scale.
Figure 5:
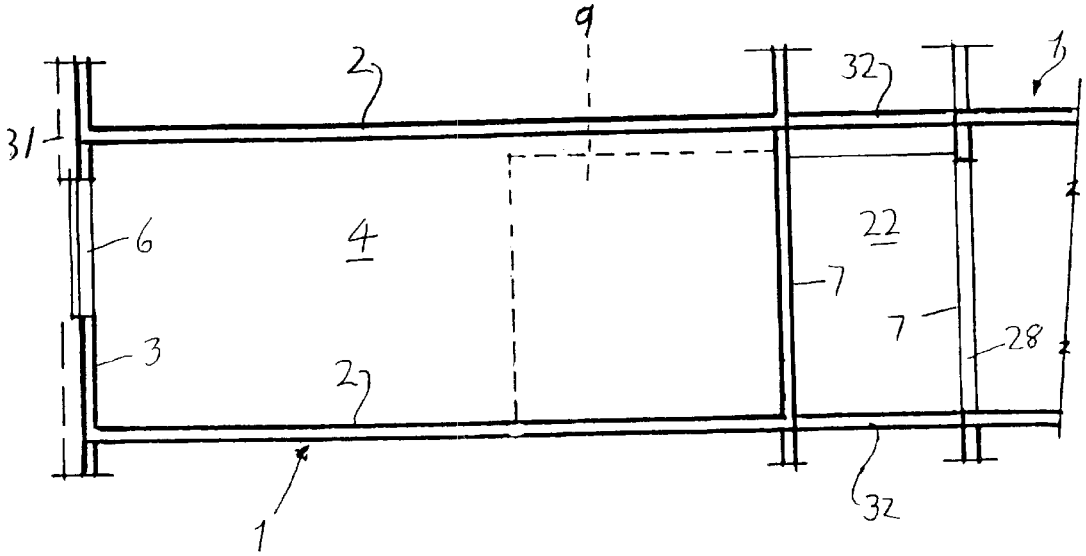
FIGS. 5 and 6 are sectional views taken along the lines 5—5 and 6—6 of FIG. 4.
Figure 6:
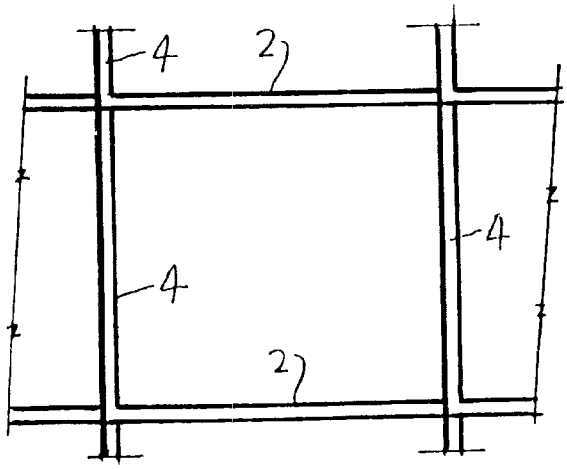

As described above, the corridor wall 7 of each room module only extends partly across the width of the module so as to provide an opening 27 for a doorway structure between the corridor and the room unit. The corridor walls 7 along each side of the corridor 22 of the lower storey are directly below the corridor walls of the upper storey and are part of a substantially vertical load plane. Corridor floor slabs 32 adjoin the floor slabs 2 of the room units on opposite sides of the corridor. FIG. 4 illustrates the plan of the room units on opposite sides of the corridor, the room units on opposite sides being identical room modules so that the door opening of a unit on one side is disposed opposite the corridor wall 7 of a unit on the opposite side. The outer skin 31 of the building cladding is attached to and covers the outer walls 3 of the room modules.

FIGS. 7 to 10 illustrate fastening devices for tying the room units together both horizontally and vertically. Hence, for horizontal tying purposes, U-shaped anchor boxes 35 are disposed in cavities 36 cast in the floor slab 2 of each module. These anchor boxes are welded to reinforcement bars 37 cast into the floor slab and extending into the cavities, each arm 38 of the U-shaped anchor box being welded to a reinforcement bar. The base 39 of each anchor box is flush with the edge of the associated floor slab and has an oversize fixing hole for tolerance purposes. Sockets 40 are cast into the bottom walls of the rebates 14 of the floor slab of each module, the mouth of the socket being flush with the bottom wall of the rebate. An anchor 41 at the opposite end of the socket extends into the floor slab. The anchor boxes of the floor slab are arranged so that they can be aligned with the sockets of an adjoining floor slab and fasteners, such as, bolts 42 having washer plates 43 can be screwed into the sockets, thereby to join the floor slab of one room module to the slab of the adjoining room module.

Figure 10:
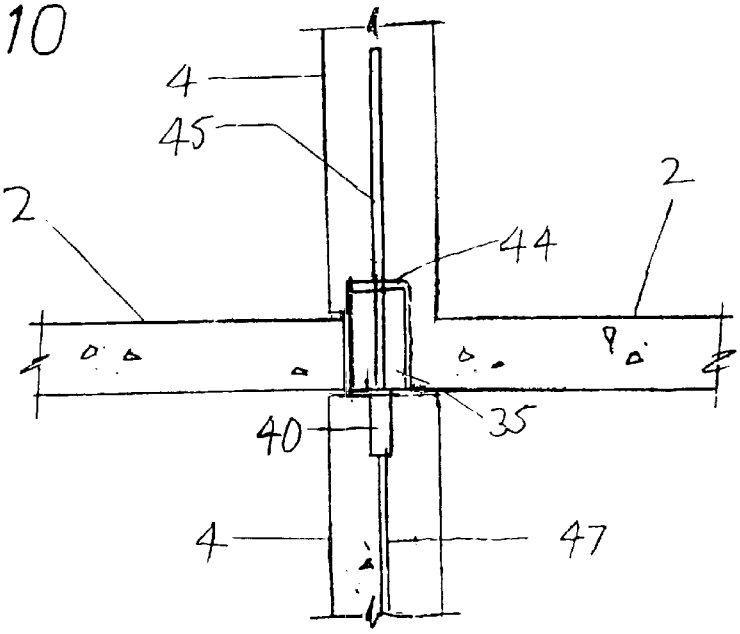
FIG. 10 is another fragmentary section illustrating the junction of FIG. 7.

Referring to FIG. 10, a similar fastening arrangement may be used for tying modules together in a vertical direction. In this case, the anchor boxes 35 are cast in cavities 44 in the underside of the floor slab beneath the associated load bearing wall 4 and are welded to reinforcement bars 45 cast into the load bearing wall and extending into these cavities. Sockets 40 are cast into the upper edge of each load bearing party wall with anchor bars 47 extending into the load bearing wall. The anchor boxes in the underside of the floor slab of each module are positioned so as to be in alignment with the sockets in the upper edge of a load bearing wall below and screw fasteners can be screwed into the sockets to join a room unit above to the load bearing wall of a room unit below.

Corridor slabs 32 may be fixed to the floor slabs of modules on opposite sides of each corridor 22 by means of fastenings similar to the anchor box and socket devices 35,40.

The slab of an upper room module may sit on a grout bed above the load bearing wall of the room module below.

FIGS. 11 to 14 illustrate alternative fastening devices for tying room modules together.

Figure 11:
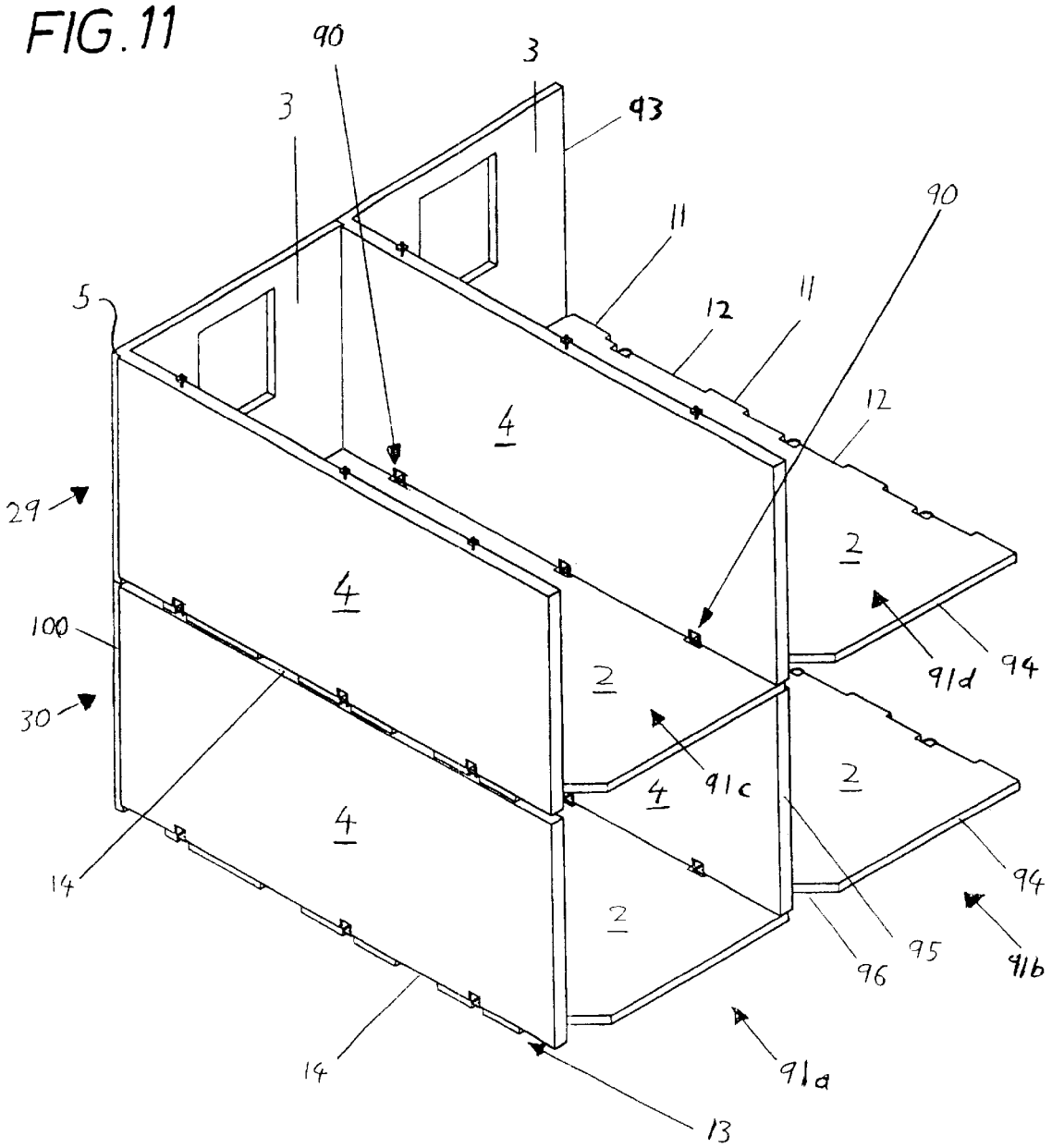
FIG. 11 is an isometric view of part of the building having th floor plan of FIG. 2 and constructed with room modules similar to FIG. 1.

FIG. 11 illustrates four room modules 91*a*,91*b*,91*c*,91*d* adjoining each other in two storeys of the modular building construction. Each module is similar to that shown in FIG. 1 but omitting the short corridor wall 7 so that the module is open at that side and opposite the load bearing wall 3. The modules are connected together by fastenings 90 at spaced positions along the top edges of the party walls 4, as will be more fully described below.

Each room module has projecting tongues 11 cast at spaced intervals along the free edge 12 of its slab and the opposite corner edge 13 is cast with complementary rebates 14 for receiving the projecting tongues of an adjoining like module. The floor slab has a rectilinear free edge 94 at its inside, opposite the outside wall 3, this inside free edge 94 being formed with a rebate 96 adjacent party wall 4 for the access of required services. At the corner 5 between the outside wall 3 and the party wall 4, the module has a rebate 100 to receive the free end of an outside wall of an adjoining room module.

Figure 12:
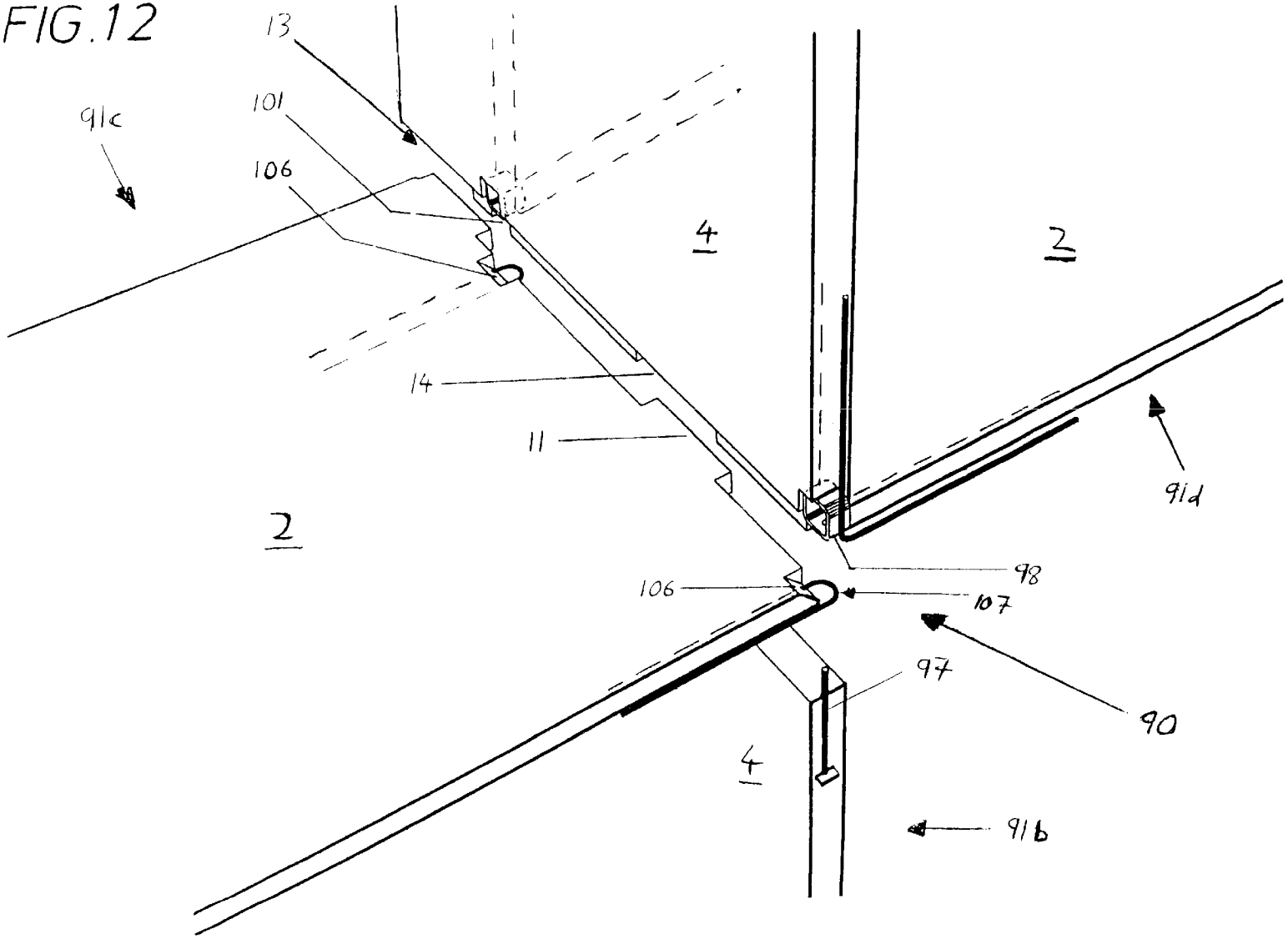
FIGS. 12 and 13 are exploded and unexploded isometric views illustrating a junction between adjoining room modules of FIG. 11.
Figure 13:
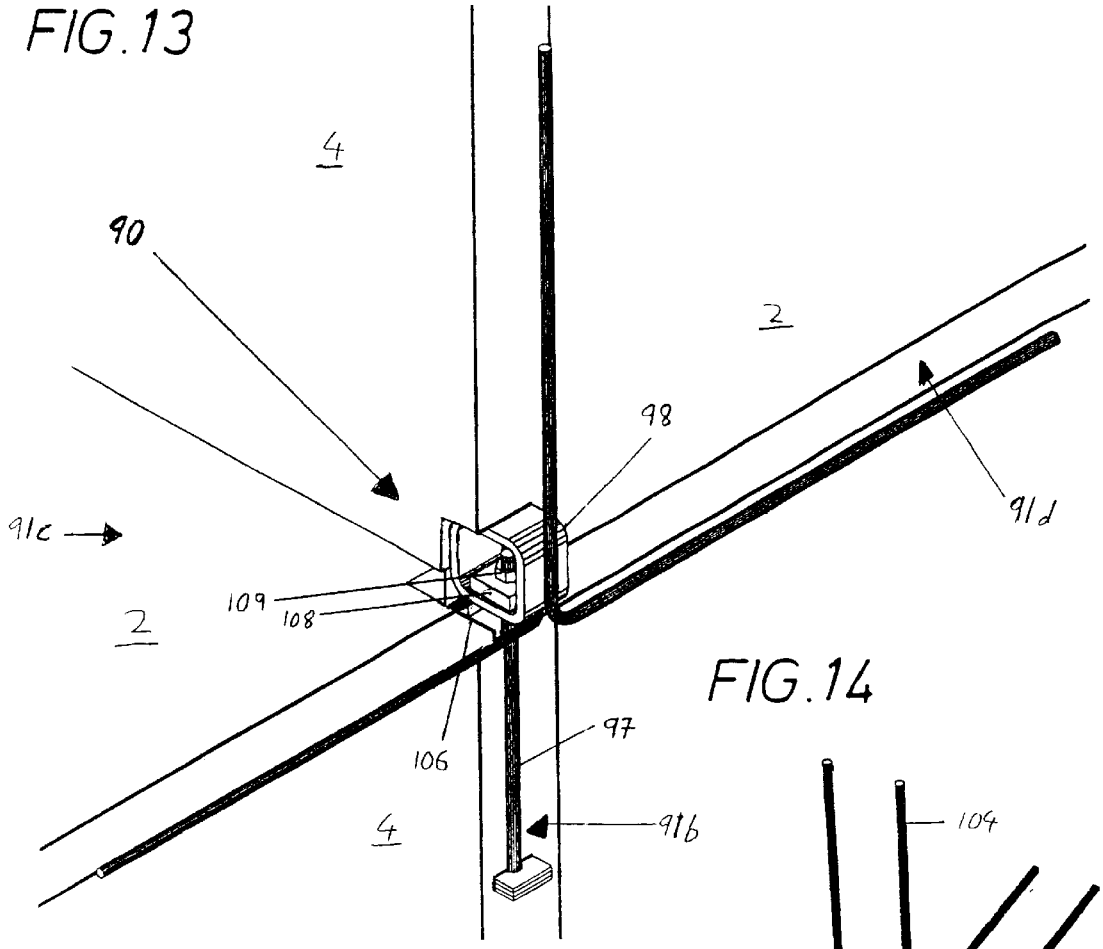
Figure 14:
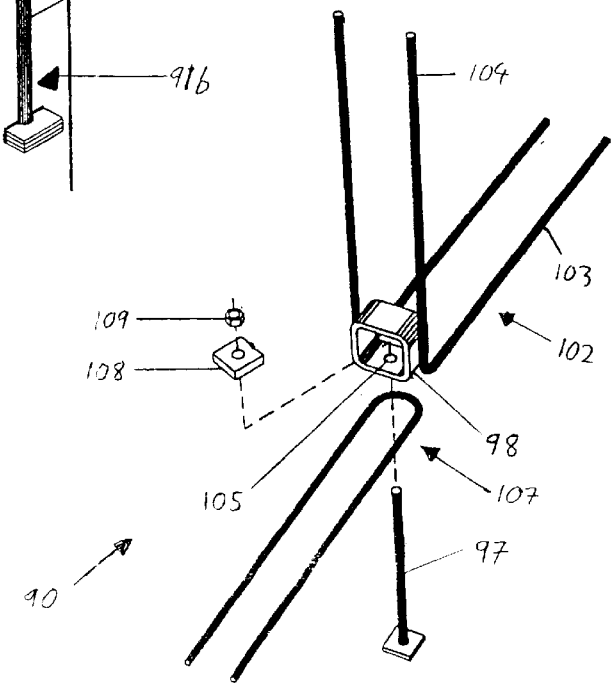
FIG. 14 is an exploded isometric view of a fastening used in the junction of FIGS. 12 and 13.

FIGS. 12 to 14 illustrate the mechanical fastenings 90 for tying room modules together both horizontally and vertically and are shown connecting together the room modules 91*b*,91*c*,91*d* of FIG. 11.

Each load bearing party wall 4 has a plurality of upright bolts 97 cast into it, the bolts projecting from the top edge of the wall. A corresponding number of anchor members or boxes 98 are cast into the bottom of the party wall immediately above the corner edge 13 so as to leave a recess 101 in the corner edge beneath each anchor box. The sides of each anchor box 98 are welded to reinforcement bars 102, each bar being bent so as to have a horizontal leg 103 and a vertical leg 104. The horizontal legs are cast into the floor slab 2 and the vertical legs are cast into the party wall 4. Thus, each anchor box is securely retained in position. The base of each anchor box contains a coupling hole 105 for engaging a bolt 97 from an adjoining module in the next storey below, the hole 105 being oversized for tolerance purposes.

The free edge 12 of each floor slab 2 opposite the party wall 4 has anchor members at spaced intervals protruding from it. These anchor members are formed from U-shaped reinforcement bars 107. The two ends of each bar 107 are cast into the slab and the loop of each U-shaped bar extends beyond the free edge so as to form a coupling hole for engaging a bolt 97 from an adjoining module in the next storey below. The U-shaped bars 107 are spaced so as to align with the anchor boxes 98 in an adjoining room module. Each U-shaped bar protrudes from a sloped rebate 106 which is inclined from the bottom of the free edge 12.

Figure 15:
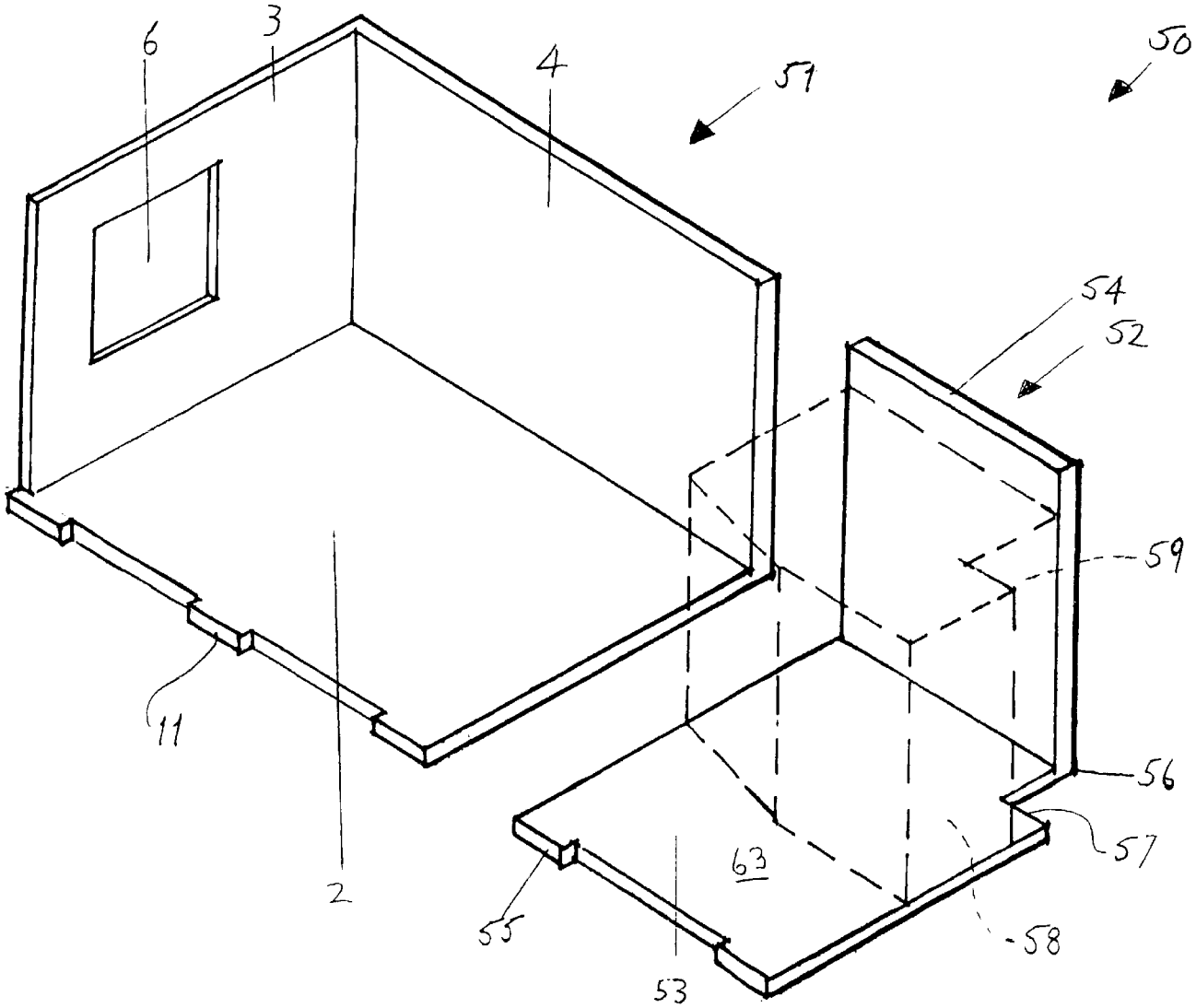
FIG. 15 is an exploded isometric view of a room unit comprising a room module similar to FIG. 1 and a supplementary module.

In erecting a building on site using the modules 91*a*,91*b*, 91*c*,91*d*, the module 91*c* is lowered onto the storey below, which includes the module 91*b*, so that its walls are aligned with and supported by the walls of the module 91*a* and its projecting tongues 11 seat on the party wall 4 of the module 91*b*. As it is lowered into position, the bolts 97 projecting from the load bearing wall of the module 91*b* fit through the coupling holes formed by the protruding U-shaped bars 107 of the module 91*c*. Next, the room module 91*d* is lowered onto the module 91*b* with its walls in alignment with the walls of module 91*b* and so that the rebates 14 along the corner edge 13 of the module 91*d* receive the tongues 11 of the module 91*c* and the corner edge seats on the upper edge of the party wall of the module 91*b*. As the room module 91*d* is lowered into this position, the bolts 97 projecting from the party wall 4 of module 91*b* fit through the coupling holes 105 of the anchor boxes 98 cast into the corner edge of the module 91*d* and the recesses 101 below these anchor boxes accommodate the protruding U-shaped bars 107 of the module 91*c* so that the latter do not prevent the module 91*d* from seating on the party wall 4 of module 91*b*. With the module 91*d* seated in position, washer plates 108 are placed inside the anchor boxes and over the projecting bolts, and nuts 109 are screwed onto the bolts to secure the fastenings and tie the room modules together in both horizontal and vertical directions. The anchor boxes 98 of room module 91*d* and the recesses 101 below are then filled with sand and cement grout or other filling material which is finished flush with the party wall, the sloped rebates 106 in the adjoining slab 2 of the module 91*c* enabling the filing material to flow into the anchor boxes and recesses.

Where a modular building construction requires larger room units than can be attained with a single module of the design of FIGS. 1 or 11 without breaching the constraints imposed by transportation and cranage considerations, each room unit may be constructed from a main room module of similar design to that shown in FIG. 1 and one or more supplementary modules of L-shape transverse section, and comprising a floor slab and a party wall, fixed to the side of the main module opposite its outer load bearing wall. FIG. 15 illustrates a room unit 50 having one such supplementary module 52. It comprises a main module 51 constructed similarly to that shown in FIG. 1, but omitting the short corridor wall 7 so that the module is open at that side and opposite the load bearing wall 3. The supplementary module 52 comprises a generally rectangular floor slab 53 and a load bearing party wall 54. Adjacent the main module 51, the floor slab and load bearing wall of the supplementary module have straight edges so as to abut the adjacent straight edges of the main module. The edge of the floor slab 53 opposite the load bearing party wall 54 is cast with tongues 55, similarly to the tongues 11 of the main module, and the corner edge 56 of the floor slab below the party wall 54 is cast with complementary rebates (not shown). At the corridor side, the floor slab 53 has a rebate 57 and the corridor edge of the wall 54 coincides with the back edge of the rebate. A bathroom pod 58 is mounted on the supplementary module and extends for the full length of the module adjacent the load bearing wall 54 and is constructed with a rebate 59 matching the rebate 57 in the floor slab so that, when assembled with similar room units, an access passage is formed for the supply of services to the bathroom pod.

Figure 16:
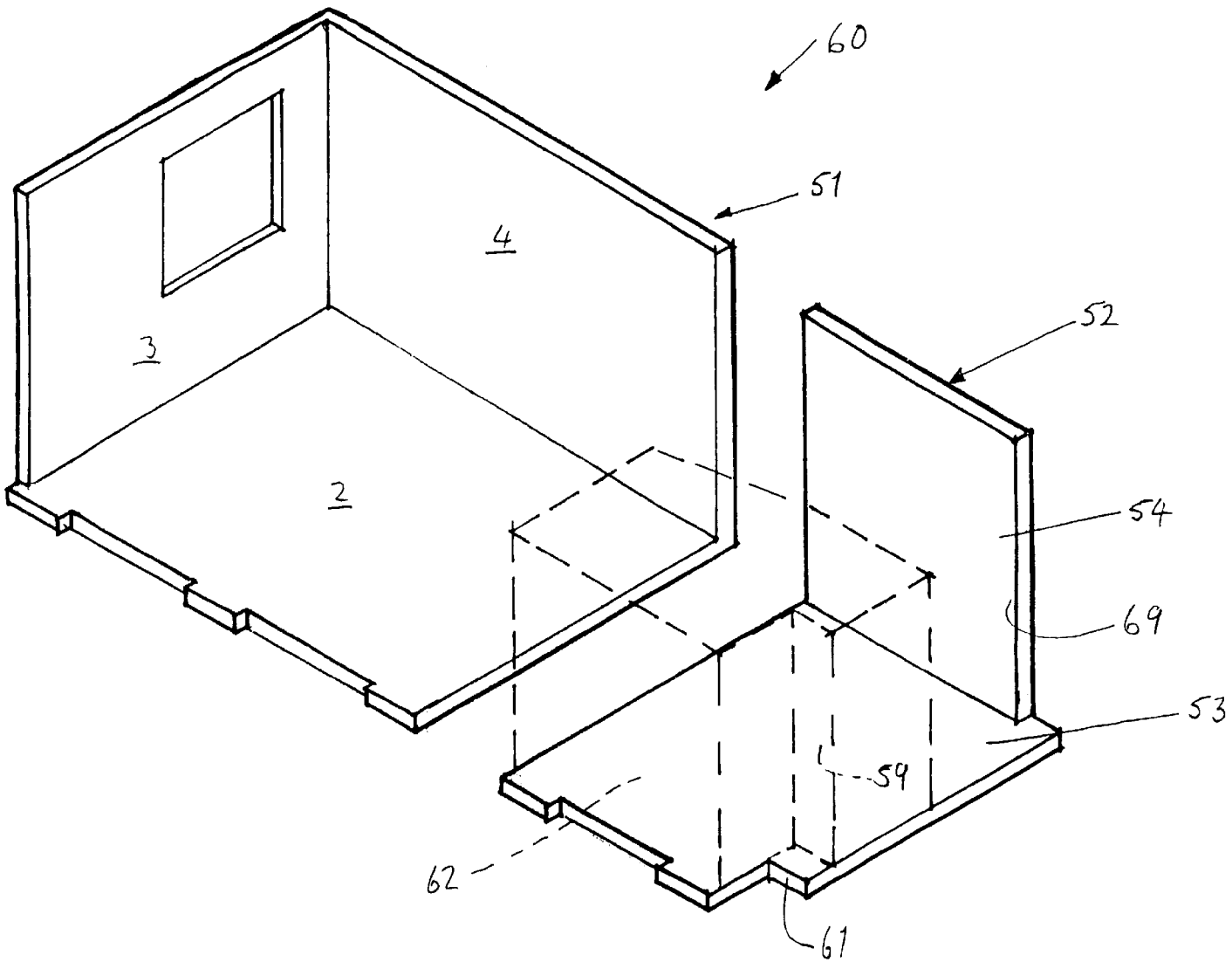
FIG. 16 illustrates an alternative embodiment of the room unit shown in FIG. 15.

The room unit 50 of FIG. 15 is intended as one of a pair of juxtaposed room units 50,60, a multiplicity of which are erected to construct a modular building. The second room unit 60 of the pair is illustrated in FIG. 16. It is the same as the unit of FIG. 15 except that the corridor edge of the floor slab 53 is rebated at 61 at its end opposite the wall 54 and the prefabricated bathroom pod 62 is a mirror image of the pod 58 of FIG. 15 and is installed at the free edge of the floor slab 53 opposite the wall 54.

Figure 17:
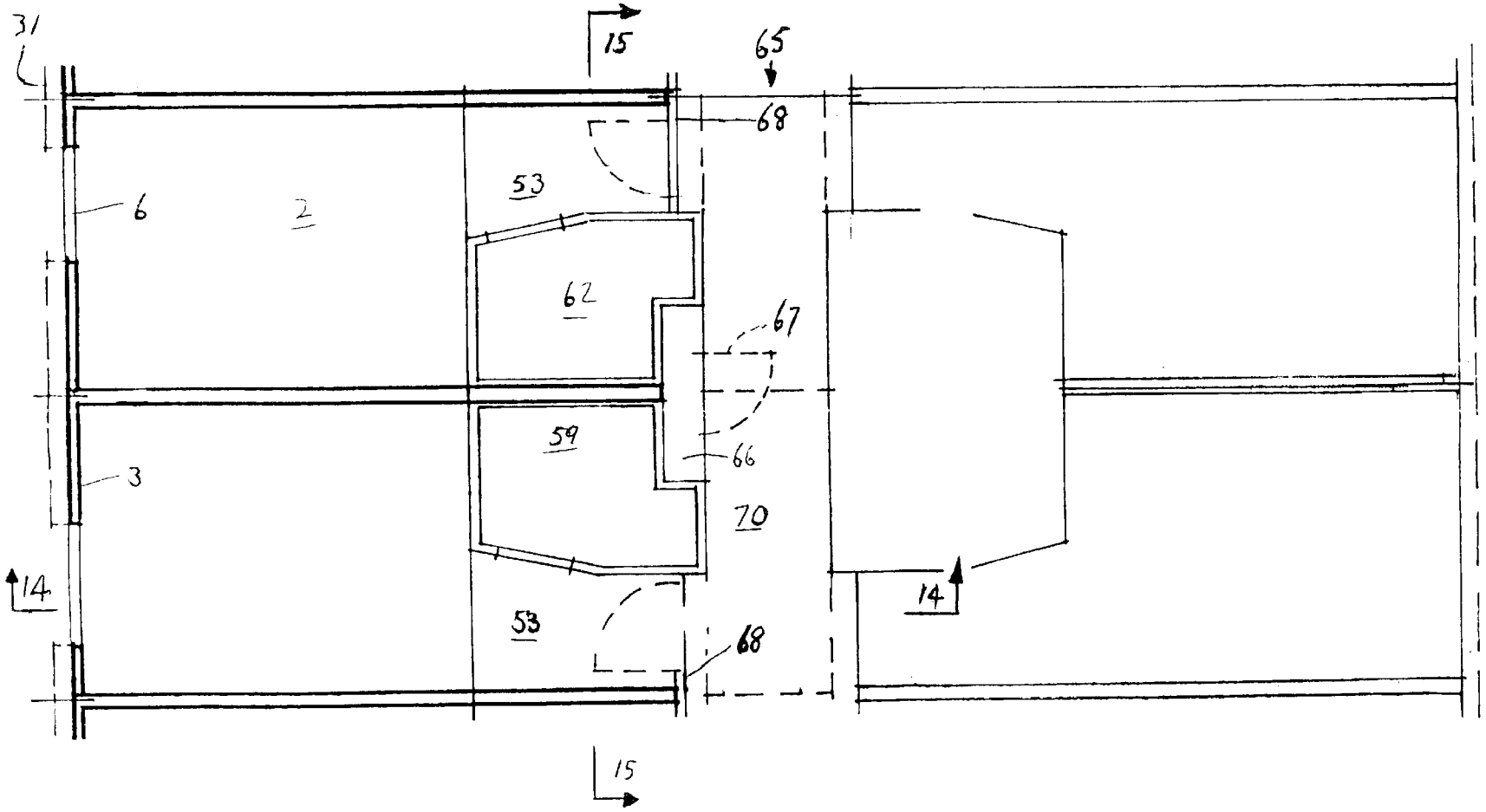
FIG. 17 is a fragmentary plan view of the floor plan of a building constructed of the room units shown in FIGS. 15 and 16.
Figure 18:
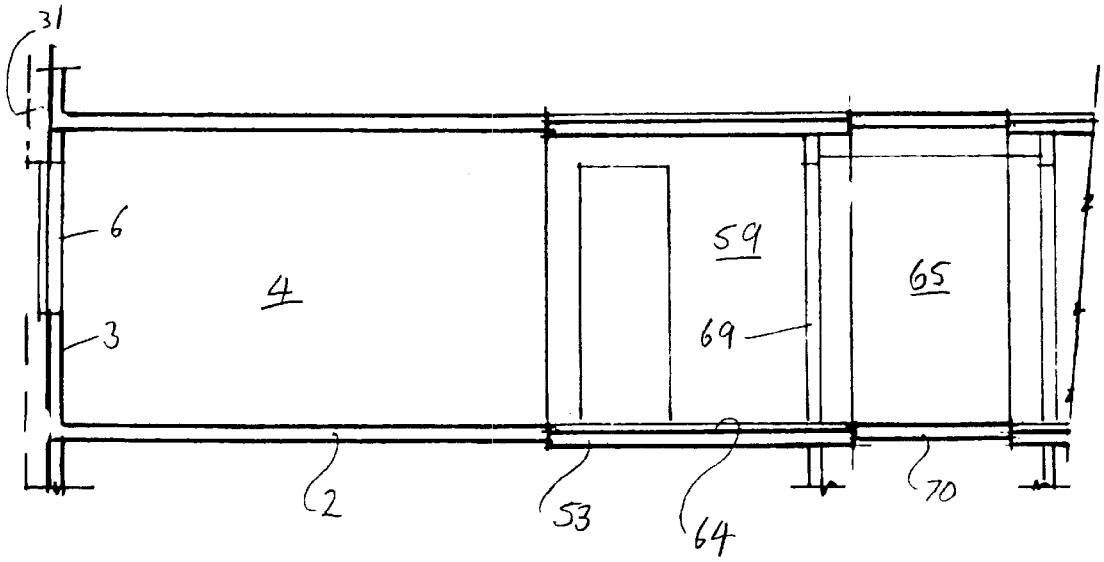
FIGS. 18 and 19 are sectional views taken along lines 14—14 and 15—15 of FIG. 17.
Figure 19:
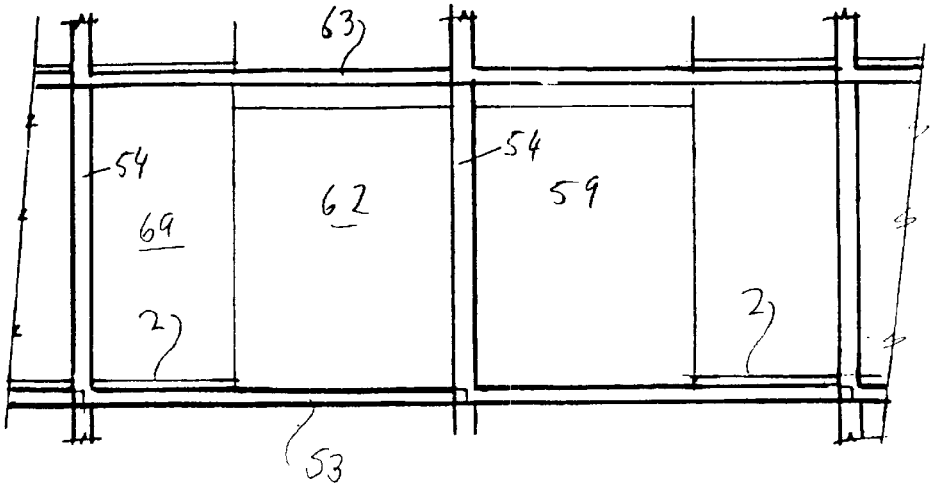

The room units 50,60 of FIGS. 15 and 16 are assembled as illustrated in FIGS. 17, 18 and 19. Each supplementary module 52 is fixed to the open end of the main module 51 with the edges of the floor slabs 2,53 and load bearing party walls 4,54 of the two modules in abutting relation by means of any suitable fastening devices, such as, devices similar to those described with reference to FIGS. 7 to 14. If there is a requirement for the floor level of the bathroom to be the same as the bedroom lobby 63 constituted by the floor slab 53 of the supplementary module outside the bathroom pod, the auxiliary module may be fixed to the main module so that it is slightly set down, for example, approximately 50 mm, to permit this to be achieved (FIG. 18). The resulting recess 64 is filled with a lightweight screed. In an alternative arrangement, the whole floor of a room unit may be raised by 50 mm with a floating floor or screed.

In a modular building constructed from room units as shown in FIGS. 15 and 16, the latter are assembled in pairs in each storey on opposite sides of a central corridor 65 (FIG. 17). The party walls 4,54 of the room units 50 of FIG. 15 form the dividing wall between the two units so that the bathroom pods 58,62 of the units are both adjacent the party wall 54 of the auxiliary module 52 of the unit 50 of FIG. 15. The rebates 57,59,61 in the floor slabs of the auxiliary modules and the pods are then disposed side-by-side in the assembled units so as to form a common passage 66 for the supply of services to the bathroom pods. The passage 66 may extend for the full height of the building. It may be closed on its corridor side by suitable partitioning provided with access doors 67. Suitable door structures 68 are mounted in the openings 69 between the pods and the adjacent party wall 54 of either the associated auxiliary module or the adjacent auxiliary module to provide for access to the associated room unit. The room units 50,60 and corridor floor slabs 70 may be tied together horizontally and vertically by mechanical fastening devices as described with reference to FIGS. 7 to 10 or 11 to 14 hereof. Also, similarly to the modular building erected with room modules as described with reference to FIG. 1, the outer walls of the main modules having the window openings 6 form the inner skin of an outer cladding system 31 secured to the outer walls 3.

The load bearing walls of the room units 50,60 shown in FIGS. 15 to 19 may, for example, be 100 mm thick, the load bearing party walls may be 100 mm thick (unless required to meet a stringent acoustic specification, when they may be up to 160 mm thick) and the floor slabs may be 100 mm thick. If a greater acoustic standard is required for the floor then a floating floor may be provided. Overall, the room unit comprising the two modules may be up to 7 m long, including the bathroom, and have a maximum internal width of 3.5 m or greater. The maximum weight of either of the two room modules is preferably 8 tonnes.

Figure 20:
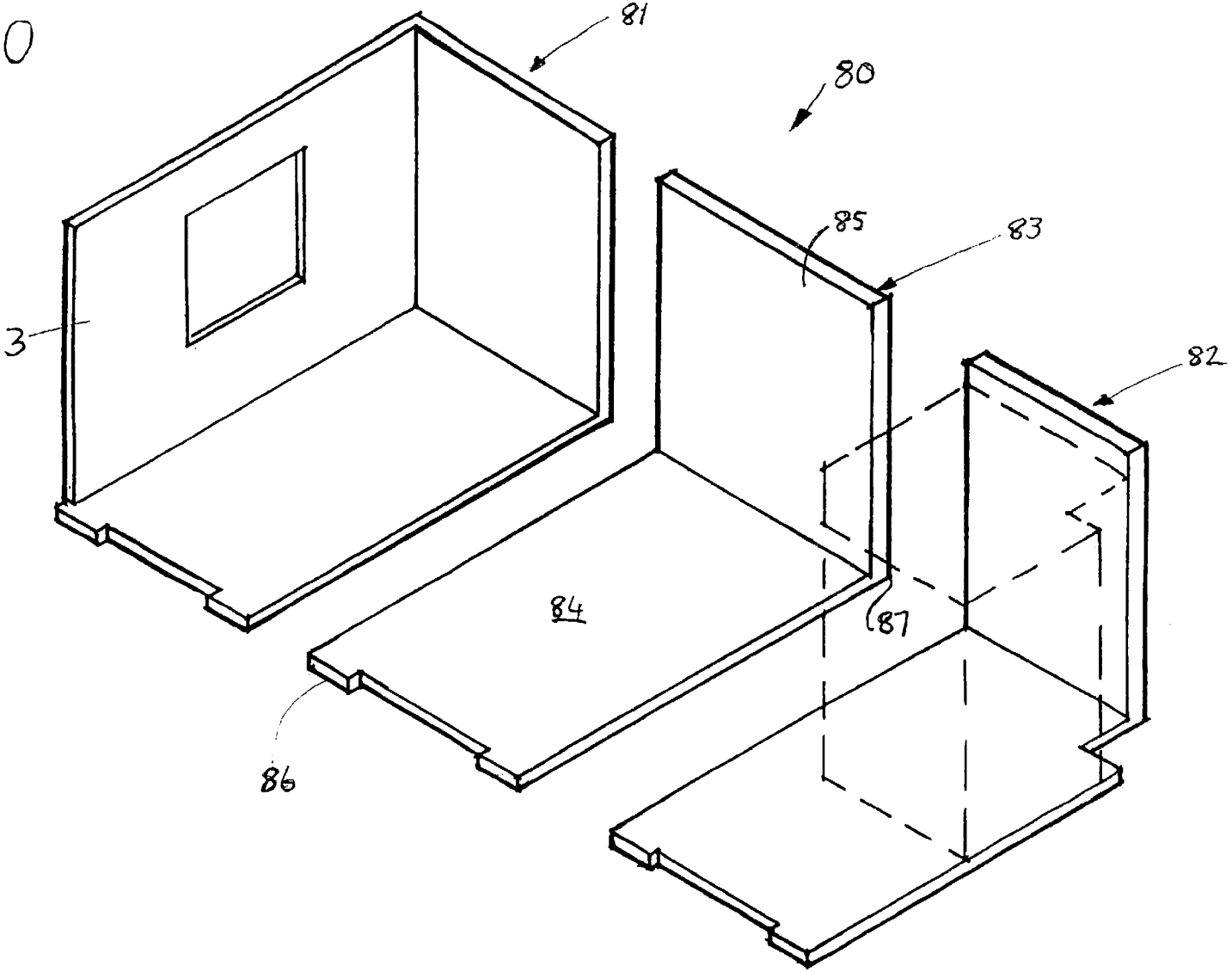
FIG. 20 is an exploded isometric view of a room unit assembled from a room module similar to FIG. 1 and two supplementary modules.
Figure 21:
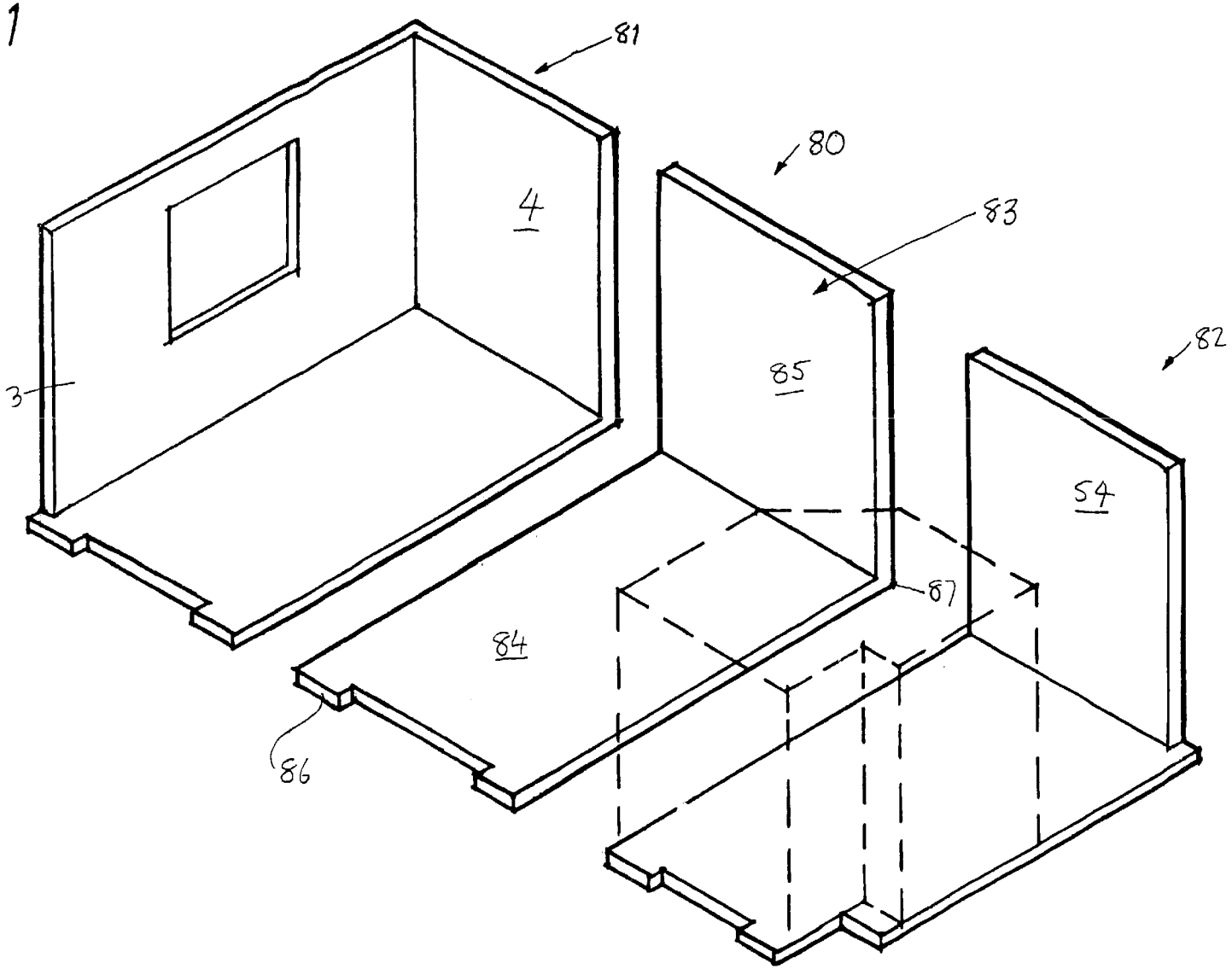
FIG. 21 illustrates an alternative embodiment of the room unit shown in FIG. 20.

A room unit 80 larger than that illustrated in FIGS. 15 and 16 and also staying within the constraints imposed by transport and cranage considerations may be constructed using a main room module and two supplementary modules, as shown in FIGS. 20 and 21. These room units comprise main modules 81 similar to the main modules 51 of FIGS. 15 and 16, although of smaller area, first supplementary modules 82 similar to the supplementary modules 52 of FIGS. 15 and 16, and second supplementary modules 83 which are fixed between the main and the first supplementary modules 81,82. Each second supplementary module 83 comprises a rectangular floor slab 84 having a load bearing party wall 85 at one side of the slab and coincident with the loading bearing party walls 4,54 of the other two modules. It also has projecting tongues 86 at its free side opposite the load bearing wall 85 and complementary rebates (not shown) at its corner edge 87 below the wall 85 so that, similarly to the other modules, the tongues 86 can rest on the load bearing wall 85 of a like room unit of the storey below. The vertical edges of the load bearing wall 85 and the adjacent horizontal edges of the floor slab 84 are mutually parallel so that the second supplementary module can be fixed in abutting relation with the adjacent open side of the main module, and the first supplementary module 82 can be fixed in abutting relation with the opposite edge of the second module by means of suitable mechanical fastening devices which may be constructed as described with reference to FIGS. 7 to 10 or 11 to 14.

Figure 22:
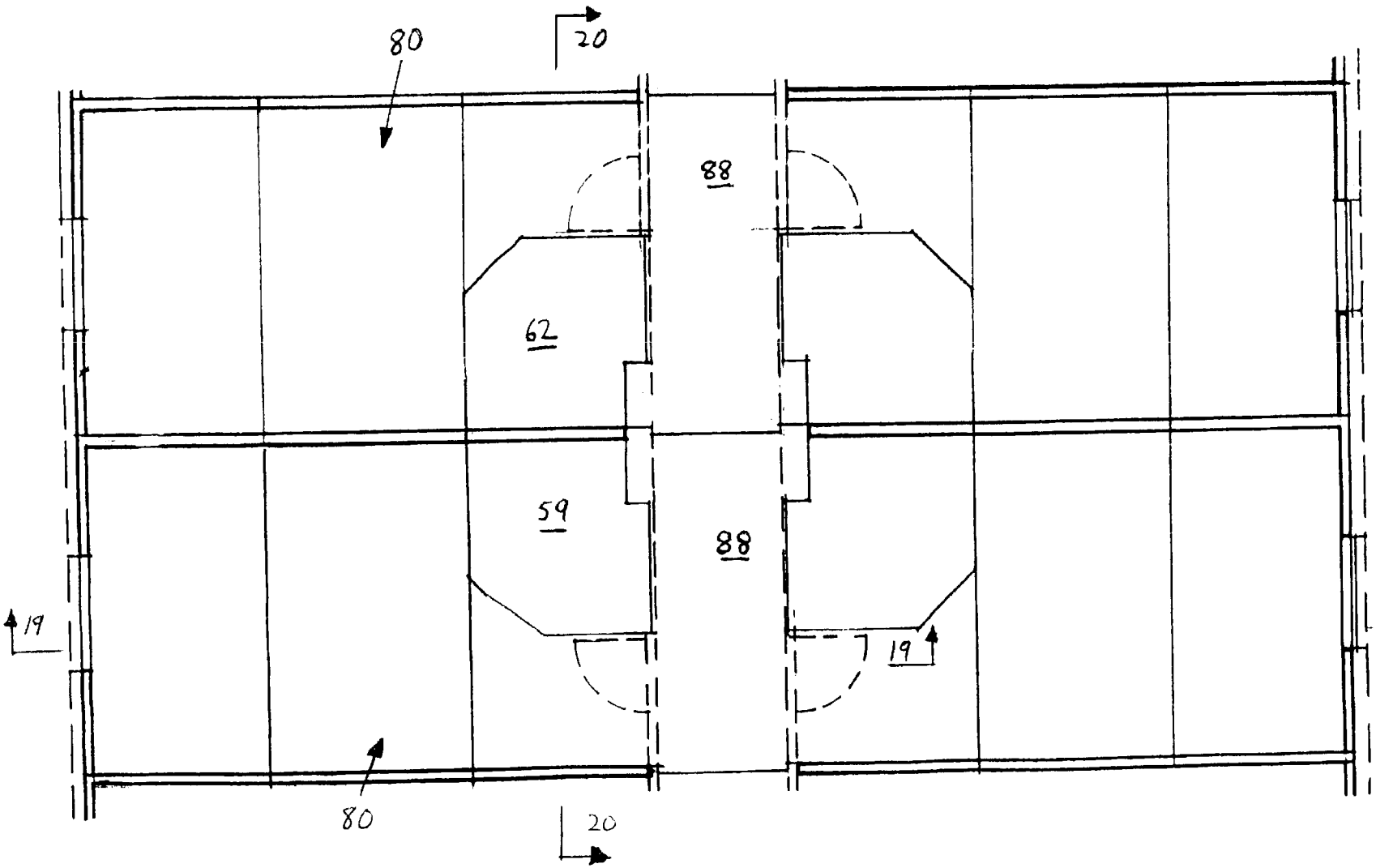
FIG. 22 is a fragmentary plan view of the floor plan of a building constructed using the room units of FIGS. 20 and 21.
Figure 23:
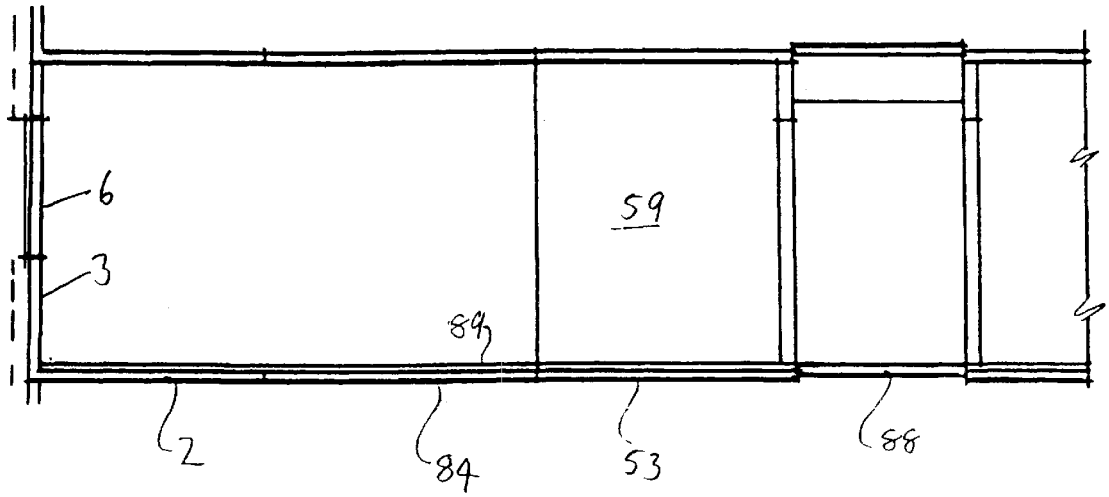
FIGS. 23 and 24 are sectional views taken along the lines 19—19 and 20—20 of FIG. 22.
Figure 24:
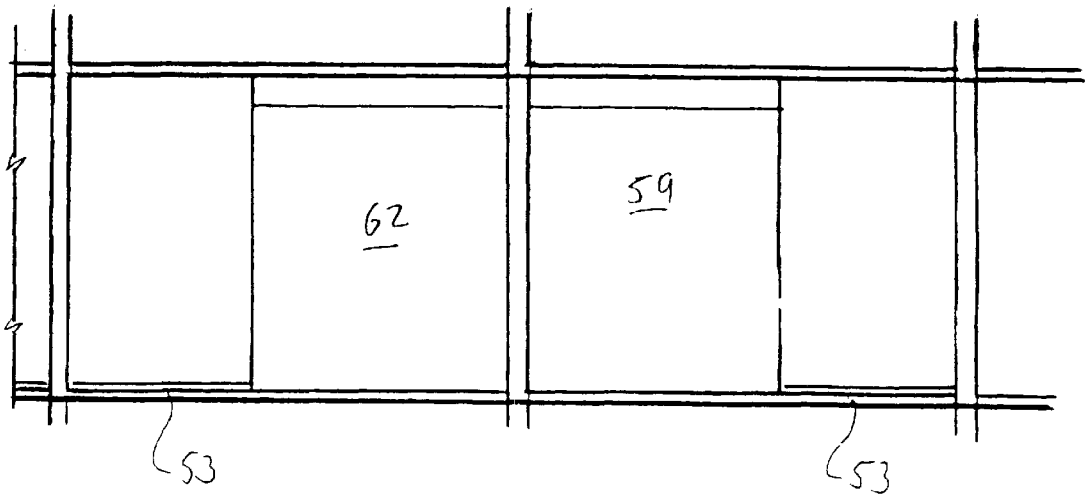

With the modules of FIGS. 20 and 21, the outer load bearing walls 3 may, for example, be 100 mm thick, the party load bearing walls 4,54,85 may be 100 mm thick (unless required to meet a stringent acoustic specification, when they may be up to 160 mm thick), and the floor slabs 2,53,84 may be 120 mm thick to accommodate the longer spans of these larger rooms. If a greater acoustic standard is required for the floor then a floating floor may be provided. The overall size of this larger room unit may be about 3.7 m×6.5 m with a maximum internal width exceeding 3.2 m. However, splitting the room unit into its three component modules maintains the room unit within the constraints imposed by transport and cranage considerations. As shown in FIGS. 22, 23 and 24, the room units 80 of FIGS. 20 and 21 are assembled in pairs, similarly to the units of FIGS. 15 and 16, in order to construct a modular building. The corridor slabs 88 may be raised slightly above the floor slabs of the room modules and the floor slabs of the units are screed 89 flush to the upper surfaces of the corridor slabs so as to bring the level of the floor slabs up to the level of the bathroom floor.

Figure 25:
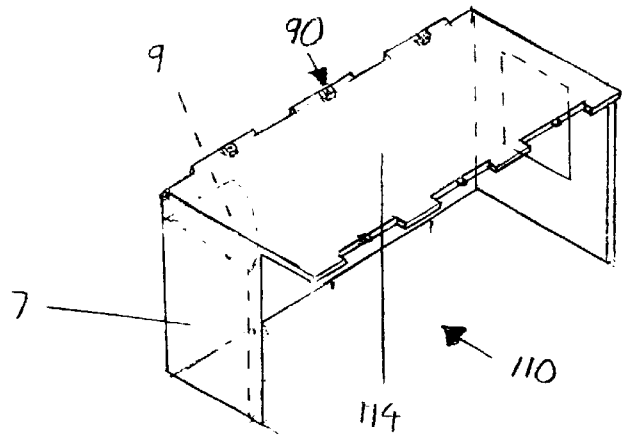
FIGS. 25 to 27 are alternative embodiments of room units shown in FIGS. 1, 15 and 20 respectively.
Figure 26:
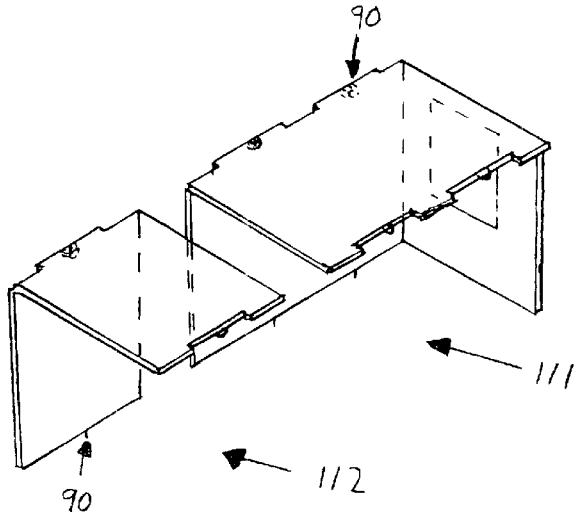
Figure 27:
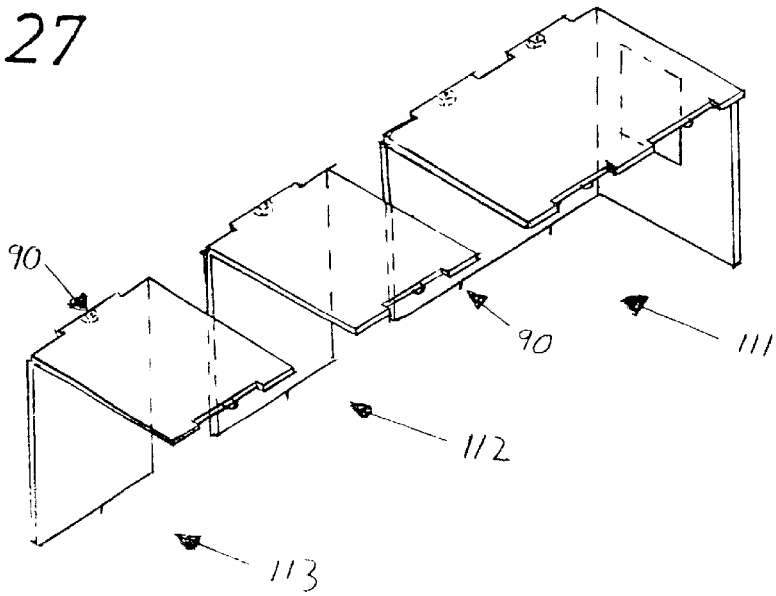

FIG. 25 illustrates a room unit comprising a room module 110 with a third wall 7 and a bathroom pod 9 and FIGS. 26 and 27 illustrate a room unit comprising a room module 111 without the third wall or pod and with one or two supplementary modules 112,113 respectively. The modules 110, 111, 112,113 are similar to the modules illustrated in FIGS. 1, 15 and 20, are precast with a ceiling slab 114 instead of with a floor slab and all are shown with mechanical fastenings 90. Each of the modules and supplementary modules shown in FIGS. 25 to 27 will interengage with and be connected to vertically and laterally adjacent modules and supplementary modules in the same manner as for the previously described modules and supplementary modules.

The modules of the embodiments hereinbefore described may be formed in inexpensive moulds as the invention does not have to allow for the casting of parallel walls or of parallel floor/ceiling slabs. The only rough surfaces resulting from the casting will be the upper surface of the ceiling slab (embodiments of FIGS. 25 to 27) and the upper surface of the floor slabs (other embodiments). These surfaces may be finished by means of a power float to produce smooth floor surfaces. When the concrete has set, the module is lifted out of the mould. The concrete wall and the ceiling surfaces are smooth and ready for immediate decoration. Plastering and rendering and similar wet trades are eliminated. Floor finishes, such as carpets or other sheet covering or tiled materials can be applied directly to the floor slab.

Figure 7:
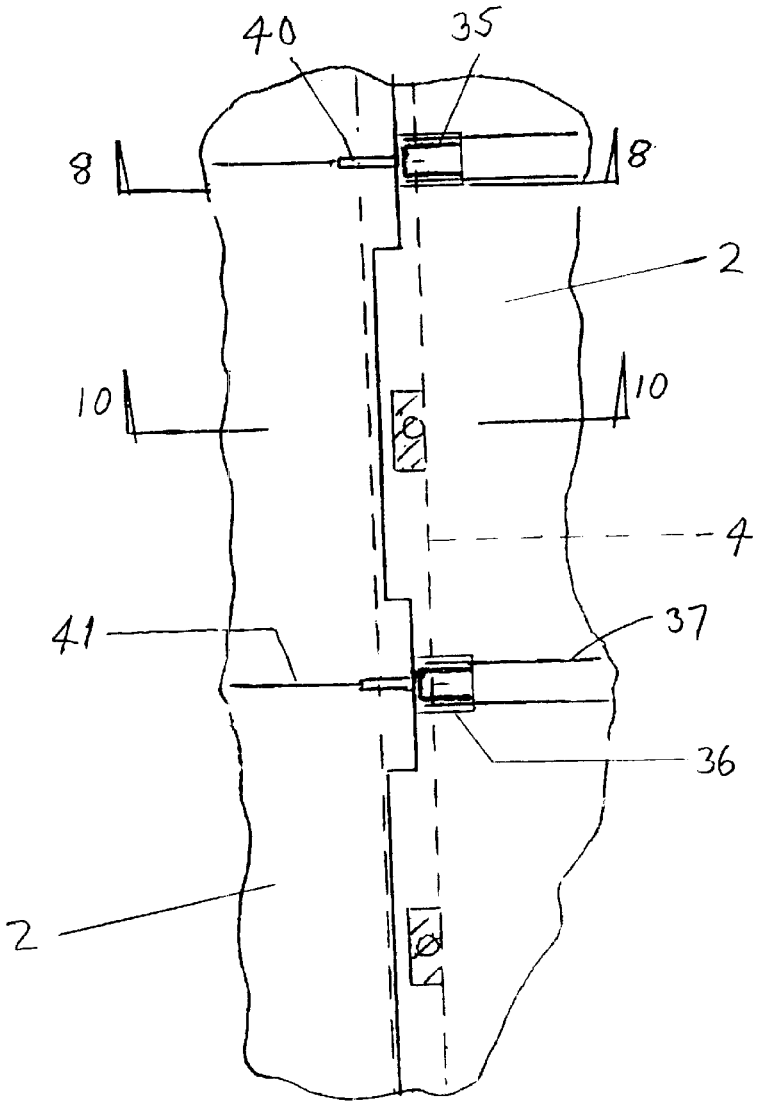
FIG. 7 is a fragmentary plan view illustrating a junction between adjoining room modules of FIGS. 2 to 6.
Figure 8:
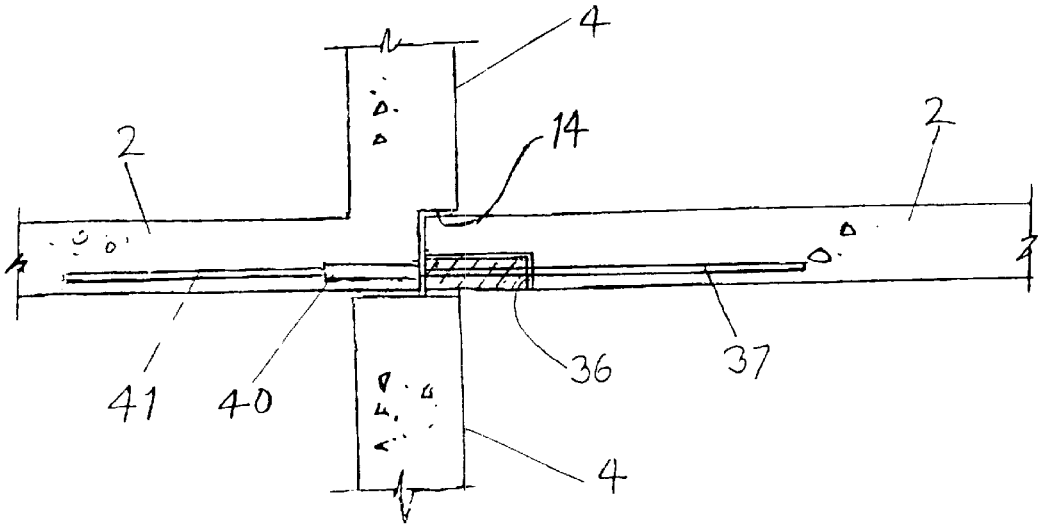
FIG. 8 is a fragmentary sectional view of the junction of FIG. 7.
Figure 9:
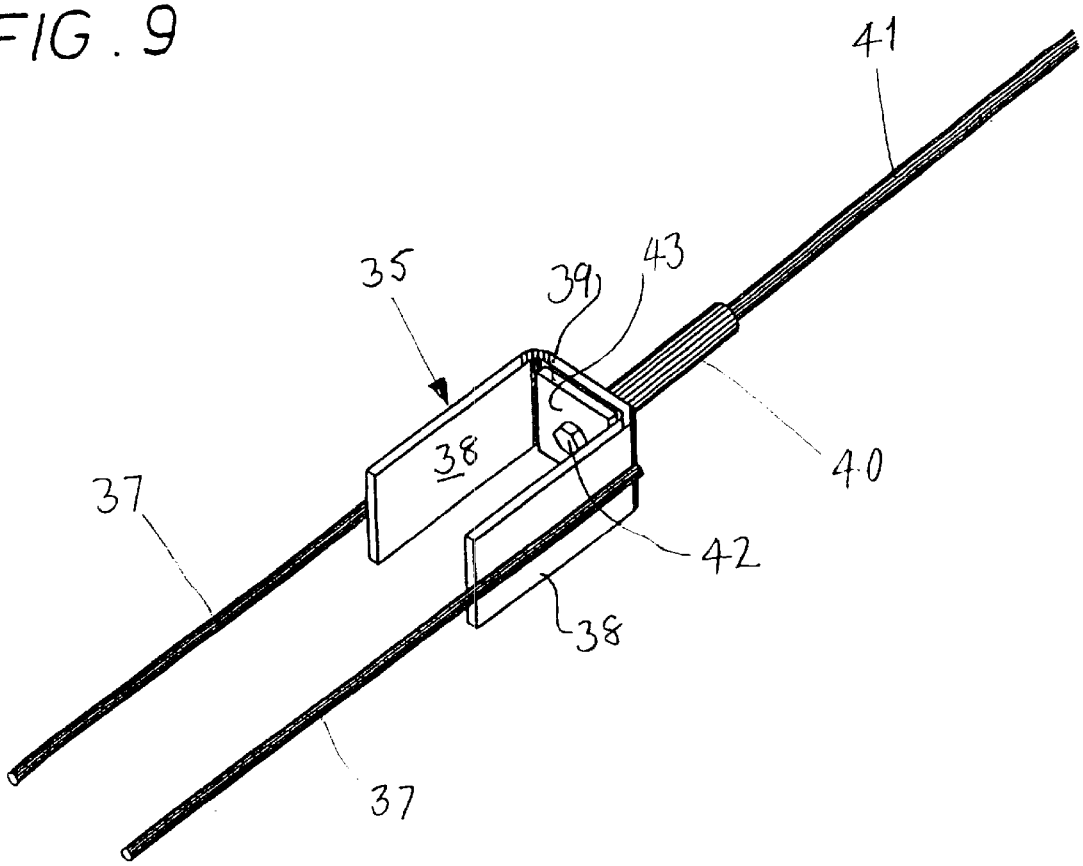
FIG. 9 is an isometric view of a fastening device used in the junction of FIGS. 7 and 8.

In a typical multi-storey building constructed from room modules according to the invention, for example, as shown in FIG. 7, all the load bearing walls are in substantially vertical planes. If any of the walls in any of the room modules in the multi-storey building fails, the walls above the failed wall will not collapse as their load is simply transferred to load bearing walls adjoining the failed wall. Thus, multi-storey buildings using these room modules are inherently resistant to progressive collapse and earthquakes without any additional strengthening being required. Such multi-storey buildings comply with current building regulations. Up to about ten storeys, the wall thicknesses of the room modules can be kept constant. Buildings of greater height can be constructed but the load bearing walls may have to be increased in thickness. The modular building has reduced dead loads. The walls of the room modules also act as deep beams and can be taken into account in foundation and structural design. Foundation requirements are therefore reduced. The floor slab of a room module is a suspended slab. Thus a room module on a ground floor has a floor slab which is ideal for spanning over bad ground conditions or for acting as a raft bearing on the ground and is cheaper than the cost of a conventional floor slab. The floor slab of a room module would normally be thinner than a conventional floor slab, allowing height savings to be achieved and, hence, reducing cladding costs.

Structural tying together of the room units is readily achieved after erection in compliance with any local regulatory requirements. Such tying together may be formed by simple bolted connections that are concealed below the floor surface at the perimeter of the floor slabs and behind the skirtings. Either of the fastening types shown in FIGS. 9 and 12 can be used to interconnect any of the main and supplementary modules, floor slabs, end walls etc.

The monolithic concrete walls and floors of the room modules according to the invention provide good acoustic insulation in a building constructed from such room modules and are inherently fire resistant. The precast concrete construction of the room modules make the modules very durable with a high resistance to impact damage and water damage.

The room modules according to the invention can be assembled rapidly and with great accuracy. No skilled building trades labour is required on site to do this. Accuracy of the base structure can greatly facilitate the installation of subsequent finishing trades, particularly outer cladding. Erection of a multi-storey building using these room modules can continue in all weathers except when high winds prevent cranage. Early watertightness is achieved as soon as windows are in place in the window openings of the room modules. The concrete finish of the room modules may be ready to receive decoration without any further preparation being required on site. Floor finishes, such as carpets or tiled materials, can be applied directly to the floor slab of a room module. Tradesmen, such as mechanical and electrical services installers, can begin work immediately following assembly of the room modules as no wet trades, such as plastering and rendering, are involved.

The prefabricated bathroom pods can be either built into the room modules prior to site delivery, saving time on site, or can be installed as the modules are assembled. Access openings for services may be preformed in the room modules and located to suit or cut on site. The room modules may also have other types of prefabricated units, such as kitchen pods. The transportation and erection on site of the room modules complete with locked off prefabricated bathroom or kitchen pods considerably reduces the risk of damage, vandalism and pilferage of valuable materials at and from the construction site.

The room modules can be dismantled and re-erected at other sites and are thus fully recyclable.

Whilst particular embodiments have been described it will be understood that various modifications may be made without departing from the scope of the invention. For example, other alternative fixing arrangements may be used to fasten adjoining room modules together or for joining modules to other parts of the building. Room units may be constructed with more than three room modules.

What is claimed is:

1. A prefabricated room module for use in the construction of a multi-storey modular building, said room module comprising:

a floor slab having sides, a wall formed along one said side of the slab, said wall having a top edge and an opposite edge and said floor slab having a side edge opposite said wall, at least one upright projection extending from said top edge of the wall, at least one first anchor member at said opposite edge of the wall, said first anchor member having a first coupling hole, at least one second anchor member projecting from said edge of the floor slab opposite said wall, said second anchor member having a second coupling hole, and securing means, whereby when the room module is placed in a modular building of a plurality of storeys having similar modules with same said projections and said first and second anchor members, said first coupling hole is adapted to engage a cooperating projection of an adjoining said module in the next storey below, said second coupling hole is adapted to engage a cooperating projection of an adjoining said module in the next storey below and said securing means is adapted to secure the projection through cooperating first and second holes of adjoining said like modules in the storey above.

2. A prefabricated room module for use in the construction of a multi-storey modular building, said room module comprising:

a ceiling slab having sides, a wall formed along one said side of the slab, said wall having a bottom edge and an opposite edge and said ceiling slab having a side edge opposite said wall, at least one upright projection extending from said bottom edge of the wall, at least one first anchor member at said opposite edge of the wall, said first anchor member having a first coupling hole, at least one second anchor member projecting from said edge of the ceiling slab opposite said wall, said second anchor member having a second coupling hole, and securing means, whereby when the room module is placed in a modular building of a plurality of storeys having similar module with same said projections and said first and second anchor members, said first coupling hole is adapted to engage a cooperating projection of an adjoining said module in the next storey above, said second coupling hole is adapted to engage a cooperating projection of an adjoining said module in the next storey above and said securing means ids adapted to secure the projection through cooperating first and second holes of adjoining like modules in the storey below.

3. A prefabricated room module for use in the construction of a modular building, said room module comprising:

a floor slab of a generally rectangular shape in plan and having sides;

first and second load bearing walls formed at two adjacent sides of said floor slab, one of said load bearing walls comprising a party wall, said floor slab further having a free edge opposite said party wall and an opposite edge, said free edge being cast with projecting tongues and said opposite edge being cast with complementary rebates;

a common corner at which said floor slab and said first and second bearing walls mutually adjoin;

fastening means cast into at least one of said sides of said slab for tying said at least one of said sides to a confronting side of a slab of a laterally adjacent identically oriented like module; and whereby when said room module is placed in a plural story modular structure having a plurality of said room modules including said tongues, rebates, and party wall, said projecting tongues are adapted to rest in the rebates of an adjacent like module in the same story and said projecting tongues are adapted to be supported by said party wall of another similar module in the story below.

4. A prefabricated room module for use in the construction of a modular building, said room module comprising:

a floor slab of generally rectangular shape in plan and having sides;

first and second load bearing walls formed at two adjacent sides of said floor slab, each said wall having a top edge, and said floor slab of said room module having at least one free edge;

a common corner at which said floor slab and said first and second load bearing walls mutually adjoin;

a first fastening means cast into said floor slab adjacent said at least one free edge for tying said at least one of said sides to a confronting side of a slab of a laterally adjacent identically oriented like module; and a second complementary fastening means being cast into said top edge of at least one said wall so as to enable the module to be tied to adjacent modules both horizontally and vertically by connection of said first fastening means and said second complementary fastening means.

5. A prefabricated room module for use in the construction of a modular building, said room module comprising:

a ceiling slab of generally rectangular shape in plan and having sides;

first and second load bearing walls formed at two adjacent sides of said ceiling slab, each said wall having a bottom edge and one of said each said wall having an edge opposite said bottom edge, said ceiling slab further having an edge opposite said edge of said one of said each said wall;

at least one upright projection extending from one said bottom edge;

at least one first anchor member at said edge of said one of said each said wall;

at least one second anchor member projecting from said edge of said ceiling slab opposite said edge of said one of said each said wall; and a common corner at which said ceiling slab and said first and second bearing walls mutually adjoin;

whereby when the room module is placed in a plural story modular structure of like modules, said first anchor member is adapted to engage a cooperating projection of an adjoining module in the next story above, and said second anchor member is adapted to engage a cooperating projection of another adjoining module in the next story above, and ties said edge of said ceiling slab opposite to said edge of said one of said each said wall to a confronting side of a slab of a laterally adjacent identically oriented like module.

6. The prefabricated room module as recited in claim 3 wherein said room module has an open face opposite said floor slab.

7. The prefabricated room module as recited in claim 3 wherein said room module has an open face opposite said one of said first and second load bearing walls.

8. The prefabricated room module as recited in claim 3 further including a prefabricated supplementary room module, said supplementary room module comprising a rectangular supplementary floor slab having sides and a load bearing supplementary party wall along one said side of said supplementary floor slab so as to respectively coincide with said floor slab and said party wall of said room module.

9. The prefabricated room module as recited in claim 3 further including at least two prefabricated supplementary room modules, each said supplementary room module comprising a rectangular supplementary floor slab having sides and a load bearing supplementary party wall along said one side of said supplementary floor slab so as to respectively coincide with the floor slab and the party wall of said room module.

10. The prefabricated room module as recited in claim 3 wherein said fastening means are cast into opposite sides of said floor slab.

11. The prefabricated room module as recited in claim 3 wherein each said first and second load bearing walls has a top edge, and said fastening means are cast into said floor slab adjacent said free edge and further including second complementary fastening means cast into said top edge of said one of said load bearing walls so as to enable the module to be tied to said adjacent and similar modules both horizontally and vertically.

12. The prefabricated room module as recited in claim 11 wherein said one of said load bearing walls has an edge opposite said top edge, said floor slab has an edge opposite said edge of said one of said load bearing walls, and said room module further includes at least one upright projection extending from said top edge, at least one first anchor member at said edge opposite said top edge of said one of said load bearing walls, and at least one second anchor member projecting from said edge of said floor slab opposite said edge of said one of said load bearing walls whereby when the room module is placed in said plural storey modular structure of said like modules, said first anchor member is adapted to engage a cooperating projection of an adjoining module in the next storey below, and said second anchor member is adapted to engage a cooperating projection of another adjoining module in the next storey below.

13. The prefabricated room module as recited in claim 12 further including means for securing said upright projection through cooperating first and second holes of first and second anchor members respectively of said adjoining like modules.

14. The prefabricated room module as recited in claim 13 further including means for securing said cooperating projections of said adjoining like modules through cooperating first and second holes of said first and second anchor members of said room module.

15. The prefabricated room module as recited in claim 12 further including means for securing said upright projection through cooperating first and second holes of first and second anchor members respectively of said adjoining like modules and for securing said cooperating projections of said adjoining like modules through cooperating first and second holes of said first and second anchor members of said room module.

16. The prefabricated room module as recited in claim 3 further including a third wall opposite said one of said load bearing walls and in adjoining relation with the other said one of said load bearing walls.

17. The prefabricated room module as recited in claim 3 wherein the module is substantially of monolithic precast and reinforced concrete construction.

18. The prefabricated room module as recited in claim 3 wherein said one of said first and second load bearing walls is prefabricated with an opening.

19. The prefabricated room module as recited in claim 3 further including a prefabricated bathroom pod.

20. The prefabricated room module as recited in claim 3 further including a prefabricated kitchen pod.

21. A modular building construction system comprising room modules as claimed in claim 3.

22. The prefabricated room module as recited in claim 4 wherein said at least one said first and second load bearing walls comprises a party wall.

23. The prefabricated room module as recited in claim 4 wherein said room module has an open face opposite said floor slab.

24. The prefabricated room module as recited in claim 4 wherein said room module has an open face opposite said one of said first and second load bearing walls.

25. The prefabricated room module as recited in claim 22 further including a prefabricated supplementary room module, said supplementary room module comprising a rectangular supplementary floor slab having sides and a load bearing supplementary party wall along one said side of said supplementary floor slab so as to respectively coincide with said floor slab and said party wall of said room module.

26. prefabricated room module as recited in claim 22 further including at least two prefabricated supplementary room modules, each said supplementary room module comprising a rectangular supplementary floor slab having sides and a load bearing supplementary party wall along said one side of said supplementary floor slab so as to respectively coincide with the floor slab and the party wall of said room module.

27. The prefabricated room module as recited in claim 22 wherein said at least one free edge is opposite said party wall and said floor slab has an opposite edge, said at least one free edge is cast with projecting tongues and said opposite edge is cast with complementary rebates whereby when said room module is placed in a plural storey modular structure having a plurality of similar room modules including tongues, rebates and a party wall, said projecting tongues are adapted to rest in the rebates of an adjacent like module in the same storey and are adapted to be supported by said party wall of another of said similar modules in the storey below.

28. The prefabricated room module as recited in claim 4 wherein said first fastening means further are cast into opposite sides of said floor slab.

29. The prefabricated room module as recited in claim 4 wherein said at least one said first and second load bearing wall has an edge opposite said top edge, said floor slab having an edge opposite said edge of said at least one said wall, and said room module including at least one first anchor member at said edge opposite said top edge of said at least one said wall, at least one upright projection extending from said top edge opposite said edge of said at least one said wall, and at least one second anchor member projecting from said edge of said floor slab opposite said edge of said at least one said wall whereby when the room module is placed in a plural storey modular structure of like modules, said first anchor member is adapted to engage in a cooperating projection of an adjoining module in the next storey below, and said second anchor member is adapted to engage a cooperating projection of another adjoining module in the next storey below.

30. The prefabricated room module as recited in claim 29 further including means for securing said upright projection through cooperating first and second holes of first and second anchor members respectively of said adjoining like modules.

31. The prefabricated room module as recited in claim 30 further including means for securing said cooperating projections of said adjoining like modules through cooperating first and second holes of said first and second anchor members of said room module.

32. The prefabricated room module as recited in claim 29 further including means for securing said upright projection through cooperating first and second holes of first and second anchor members respectively of said adjoining like modules and for securing said cooperating projections of said adjoining like modules through cooperating first and second holes of said first and second anchor members of said room module.

33. The prefabricated room module as recited in claim 4 further including a third wall opposite said at least one said load bearing wall and in adjoining relation with the other said at least one said load bearing wall.

34. The prefabricated room module as recited in claim 4 wherein the module is substantially of monolithic precast and reinforced concrete construction.

35. The prefabricated room module as recited in claim 4 wherein said at least one said load bearing wall is prefabricated with an opening.

36. The prefabricated room module as recited in claim 4 further including a prefabricated bathroom pod.

37. The prefabricated room module as recited in claim 4 further including a prefabricated kitchen pod.

38. A modular building construction system comprising room modules as claimed in claim 4.

39. The prefabricated room module as recited in claim 5 wherein said one of said each said load bearing wall comprises a party wall.

40. The prefabricated room module as recited in claim 5 wherein said room module has an open face opposite said ceiling slab.

41. The prefabricated room module as recited in claim 5 wherein said room module has an open face opposite said one of said each said load bearing wall.

42. The prefabricated room module as recited in claim 39 further including a prefabricated supplementary room module, and supplementary room module comprising a rectangular supplementary ceiling slab having sides and a load bearing supplementary party wall along one said side of said supplementary ceiling slab so as to respectively coincide with said ceiling slab and said party wall of said room module.

43. The prefabricated room module as recited in claim 39 further including at least two prefabricated supplementary room modules, each said supplementary room module comprising a rectangular supplementary ceiling slab having sides and a load bearing supplementary ceiling slab along said one side of said supplementary ceiling slab so as to respectively coincide with the ceiling slab and the party wall of said room module.

44. The prefabricated room module as recited in claim 39 wherein said ceiling slab has a free edge opposite said party wall and said ceiling slab has an opposite edge, said free edge is cast with projecting tongues and said opposite edge is cast with complementary rebates, whereby when said room module is placed in a plural storey modular structure having a plurality of similar room modules including tongues, rebates and a party wall, said projecting tongues are adapted to rest in the rebates of an adjacent like module in the same storey and are adapted to be supported by the party wall of said adjacent module.

45. The prefabricated room module as recited in claim 5 further including fastening means cast into opposite sides of said ceiling slab.

46. The prefabricated room module as recited in claim 5 further including fastening means and wherein the ceiling slab of said room module has at least one free edge, said fastening means being cast into said ceiling slab adjacent said at least one free edge and complementary fastening means being cast into said bottom edge of said one of said each said wall so as to enable the module to be tied to said adjacent and adjoining modules both horizontally and vertically by connection of said fastening means and said complementary fastening means.

47. The prefabricated room module as recited in claim 5 further including means for securing said upright projection through cooperating first and second holes of first and second anchor members respectively of said adjoining like modules.

48. The prefabricated room module as recited in claim 47 further including means for securing said cooperating projections of said adjoining like modules through cooperating first and second holes of said first and second anchor members of said room module.

49. The prefabricated room module as recited in claim 5 further including means for securing said upright projection through cooperating first and second holes of first and second anchor members respectively of said adjoining like modules and for securing said cooperating projections of said adjoining like modules through cooperating first and second holes of said first and second anchor members of said room module.

50. The prefabricated room module as recited in claim 5 further including a third wall opposite said one of said each said wall and in adjoining relation with the other said one of said each said wall.

51. The prefabricated room module as recited in claim 5 wherein the module is substantially of monolithic precast and reinforced concrete construction.

52. The prefabricated room module as recited in claim 5 wherein said one of said each said wall is prefabricated with an opening.

53. The prefabricated room module as recited in claim 5 further including a prefabricated bathroom pod.

54. The prefabricated room module as recited in claim 5 further including a prefabricated kitchen pod.

55. A modular building construction system comprising room modules as claimed in claim 5.

* * * * *